US010768569B2

(12) United States Patent
Saito

(10) Patent No.: US 10,768,569 B2
(45) Date of Patent: Sep. 8, 2020

(54) FIXING DEVICE AND IMAGE FORMING APPARATUS

(71) Applicant: CANON KABUSHIKI KAISHA, Tokyo (JP)

(72) Inventor: Shutaro Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 320 days.

(21) Appl. No.: 15/892,801

(22) Filed: Feb. 9, 2018

(65) Prior Publication Data

US 2018/0231931 A1 Aug. 16, 2018

(30) Foreign Application Priority Data

Feb. 11, 2017 (JP) ..... 2017-022990

(51) Int. Cl.
*G03G 15/00* (2006.01)
*G03G 21/00* (2006.01)
*G03G 15/20* (2006.01)

(52) U.S. Cl.
CPC ..... *G03G 15/70* (2013.01); *G03G 15/2028* (2013.01); *G03G 15/6573* (2013.01); *G03G 2215/00413* (2013.01); *G03G 2215/00548* (2013.01); *G03G 2215/00616* (2013.01); *G03G 2215/00675* (2013.01)

(58) Field of Classification Search
CPC ..... G03G 15/70; G03G 15/706; G03G 2215/00548; G03G 2215/00611; G03G 2215/00616
See application file for complete search history.

(56) References Cited

U.S. PATENT DOCUMENTS

| | | | | |
|---|---|---|---|---|
| 6,615,017 | B2 | 9/2003 | Tanaka | |
| 8,779,335 | B2 | 7/2014 | Saito | |
| 8,958,716 | B2 | 2/2015 | Saito | |
| 9,389,554 | B2 | 7/2016 | Tanaka et al. | |
| 9,465,336 | B2 | 10/2016 | Saito et al. | |
| 9,563,163 | B2 | 2/2017 | Tanaka et al. | |
| 2008/0131177 | A1* | 6/2008 | Aratachi | G03G 15/70 399/322 |
| 2012/0219337 | A1* | 8/2012 | Endo | B65H 5/062 399/381 |

(Continued)

FOREIGN PATENT DOCUMENTS

JP 2002-099174 A 4/2002

*Primary Examiner* — Jill E Culler
*Assistant Examiner* — Ruben C Parco, Jr.
(74) *Attorney, Agent, or Firm* — Venable LLP

(57) ABSTRACT

A fixing device includes first and second rotatable members; a movable member; a first supporting side plate including an opening; a second supporting side plate; a detecting portion; a supporting plate; a holding portion; a slit portion; a first projected portion; a second projected portion; and a hole. When the position of the holding portion with respect to the height direction is regulated by the second projected portion in contact with the supporting plate, in a projection plane in which the outside of the first supporting side plate is viewed in the longitudinal direction of the first rotatable member, the flag portion is accommodated inside the opening and is in a non-overlapping position with the detecting portion. When the projected portion is engaged in the hole, in the projection plane, the flag portion is in an overlapping position with the detecting portion.

20 Claims, 11 Drawing Sheets

(56) References Cited

U.S. PATENT DOCUMENTS

| | | | | |
|---|---|---|---|---|
| 2014/0153938 | A1 | 6/2014 | Saito | |
| 2014/0339763 | A1* | 11/2014 | Watatani | B65H 7/14<br>271/265.01 |
| 2018/0081314 | A1* | 3/2018 | Suzuki | B65H 7/14 |

* cited by examiner (a) FROM X DIRECTION (b) FROM Z DIRECTION (a) FROM Y DIRECTION (b) FROM X DIRECTION (c) FROM Z DIRECTION (a) FROM Y DIRECTION (b) FROM X DIRECTION (c) FROM Z DIRECTION (a) FROM Y DIRECTION (b) FROM X DIRECTION (c) FROM Z DIRECTION

FIXING DEVICE AND IMAGE FORMING APPARATUS

FIELD OF THE INVENTION AND RELATED ART

The present invention relates to a fixing device and an image forming apparatus.

In recent years, the image forming apparatus is desired to enable output of a product correspondingly to various media, and a various media-compatible technique is needed. In the fixing device of the image forming apparatus, as one of the needed various media-compatible technique, prevention of generation of a "fixing (member) winding jam" such that various recording materials passed through a nip are wound about a fixing member without being separated from the fixing member is cited. In addition, a technique such that in the case where the "fixing winding jam" generated, immediate detection of the jam and stop of the fixing device is also a necessary technique. This is because it becomes more difficult to handle the recording material as it takes a longer time to detect the recording material and a proportion of a length of the recording material wound about the fixing member is larger when the fixing device stops.

In view of the above problem, Japanese Laid-Open Patent Application (JP-A) 2002-99174 proposes a fixing device in which a sheet discharge sensor for detecting the generation of the "fixing winding jam" is provided is proposed. By disposing the sheet discharge sensor in the neighborhood of a nip of a fixing member, in the case where the "fixing winding jam" generated, the jam can be detected early.

As disclosed in JP-A 2002-99174, in the case where the sheet discharge sensor is disposed inside the fixing device, a technique such that a sensor flag including a rotatable flag portion and a photo-interrupter switched in logic by light transmission/light blocking with the flag portion are used in combination is frequently employed. In such a constitution, assembling is required to be carried out so that the flag portion of the sensor flag enters an optical axis portion formed by a light emitting portion (light emitting element) and a light receiving portion (photosensor) of the photo-interrupter.

Further, it is not desirable that the photo-interrupter is disposed in a high temperature environment from the viewpoint of a heat-resistant property of an electric substrate mounted therein. In the fixing device of the image forming apparatus, a casing of the fixing device is provided with an opening and the flag portion is disposed outside the casing through the opening while disposing a detecting portion of the sheet discharge sensor in a feeding region of the recording material, and thus the photo-interrupter is disposed outside the casing which has a relatively low ambient (environmental) temperature in some cases. Further, the opening may desirably be set so as to be small to the extent possible in order to enhance strength and rigidity of the casing itself.

In the prior art, the assembling is carried out so that the flag portion of the sensor flag does not contact the photo-interrupter and the casing, i.e., a so-called "tilt assembling" is used frequently.

In recent years, in the image forming apparatus, in order to achieve a high quality and stable operation, it is required that a product is shipped in a further high-quality state. For that purpose, not only improvement in quality and performance of discrete component parts but also suppression of problems generating during assembling of the component parts and during maintenance in the market by a service person are important problems to be solved. Specifically, generation of deformation, breakage and the like of the parts due to unintentional contact with peripheral component parts when the parts are mounted is cited.

In the case where the sensor flag is subjected to the tilt assembling as in the prior art, in a mounting step thereof, when the sensor flag moves along a locus other than a proper locus, the sensor flag unintentionally contacts the photo-interrupter and the peripheral component parts in some cases. As a result, there is a possibility that the above problems generate.

Further, use of a constitution in which the fixing device can be automatically assembled by an automatic machine in order to stably assembling the fixing device is also one of necessary techniques. In the case where the component parts are subjected to the tilt assembling by the automatic machine, there is a need to move the component parts with a high degree of freedom, so it becomes difficult for the automatic machine to ready for the tilt assembling. Alternatively, there is a problem such that a very expensive automatic machine such as a robot arm is required to be used.

SUMMARY OF THE INVENTION

A principal object of the present invention is to provide a fixing device and an image forming apparatus, in which a movable member including a flag portion movable between a light emitting portion and a light receiving portion of a detecting portion can be positioned relative to the detecting portion with high accuracy in an assembling operation thereof.

According to an aspect of the present invention, there is provided a fixing device comprising: first and second rotatable members forming a nip where a toner image on a recording material is formed; a movable member movable by arrival of the recording material at a predetermined position which is downstream of the nip with respect to a recording material feeding direction and which is within a passing region in which the recording material is passable with respect to a longitudinal direction of the first rotatable member, wherein the movable member includes a contact portion contactable to the recording material being in the predetermined position and includes a flag portion movable together with movement of the contact portion by the recording material contacting the contact portion; a first supporting side plate positioned outside the passing region with respect to the longitudinal direction and configured to rotatably support the first rotatable member, wherein the first supporting side plate including an opening having such a size that the flag portion is passable; a second supporting side plate positioned opposite from the first supporting side plate sandwiching the passing region therebetween with respect to the longitudinal direction and configured to rotatably support the first supporting side plate; a detecting portion including a light emitting portion and a light receiving portion and configured to detect the flag portion movable between the light emitting portion and the light receiving portion, wherein the detecting portion is positioned in an outside of the first supporting side plate with respect to the longitudinal direction, the outside being opposite from the passing region sandwiching the first supporting side plate between itself and the passing region with respect to the longitudinal direction; a supporting plate extending in the longitudinal direction so as to be connected with the first and second supporting side plates; a holding portion holding the movable member, wherein in a state that the holding portion holds the movable member, the holding portion is assembled with the supporting plate connected with the first and second supporting side plates; a slit portion configured to guide movement of the holding portion in a predetermined direction from the passing region toward the opening of the first supporting side plate so that the flag portion passes from the passing region through the opening in an assembling operation in which the holding portion is assembled with the supporting plate; a first projected portion configured to guide the movement of the holding portion in the predetermined direction in engagement with the slit; a second projected portion provided on the holding portion, wherein the second projected portion regulates a position of the holding portion relative to the supporting plate with respect to a height direction in contact with the supporting plate when the holding portion is moved in the predetermined direction by being guided by the slit portion and the first projected portion, the height direction being perpendicular to a holding portion supporting surface of the supporting plate; and a hole provided in the supporting plate, wherein the hole is disposed at a position where the second projected portion engages with the hole when the flag portion is positioned between the light emitting portion and the light receiving portion with respect to the longitudinal direction by movement of the holding portion in the predetermined direction by guidance of the slit portion and the first projected portion, wherein when the position of the holding portion with respect to the height direction is regulated by the second projected portion in contact with the supporting plate, in a projection plane in which the outside of the first supporting side plate is viewed in the longitudinal direction from a position between the light emitting portion and the receiving portion with respect to the longitudinal direction, the flag portion is accommodated inside the hole and is in a non-overlapping position with the detecting portion, and wherein when the projected portion is engaged in the hole, in the projection plane, the flag portion is in an overlapping position with the detecting portion.

According to another aspect of the present invention, there is provided a fixing device comprising: first and second rotatable members forming a nip where a toner image on a recording material is formed; a movable member movable by arrival of the recording material at a predetermined position which is downstream of the nip with respect to a recording material feeding direction and which is within a passing region in which the recording material is passable with respect to a longitudinal direction of the first rotatable member, wherein the movable member includes a contact portion contactable to the recording material being in the predetermined position and includes a flag portion movable together with movement of the contact portion by the recording material contacting the contact portion; a first supporting side plate positioned outside the passing region with respect to the longitudinal direction and configured to rotatably support the first rotatable member, wherein the first supporting side plate including an opening having such a size that the flag portion is passable; a second supporting side plate positioned opposite from the first supporting side plate sandwiching the passing region therebetween with respect to the longitudinal direction and configured to rotatably support the first supporting side plate; a detecting portion including a light emitting portion and a light receiving portion and configured to detect the flag portion movable between the light emitting portion and the light receiving portion, wherein the detecting portion is positioned in an outside of the first supporting side plate with respect to the longitudinal direction, the outside being opposite from the passing region sandwiching the first supporting side plate between itself and the passing region with respect to the longitudinal direction; a supporting plate extending in the longitudinal direction so as to be connected with the first and second supporting side plates; a holding portion holding the movable member, wherein in a state that the holding portion holds the movable member, the holding portion is assembled with the supporting plate connected with the first and second supporting side plates; a slit portion configured to guide movement of the holding portion in a predetermined direction from the passing region toward the opening so that the flag portion passes from the passing region through the opening in an assembling operation in which the holding portion is assembled with the supporting plate; a first projected portion configured to guide the movement of the holding portion in the predetermined direction in engagement with the slit; a second projected portion provided on the supporting plate, wherein the second projected portion regulates a position of the holding portion relative to the supporting plate with respect to a height direction in contact with the holding portion when the holding portion is moved in the predetermined direction by being guided by the slit portion and the first projected portion, the height direction being perpendicular to a holding portion supporting surface of the supporting plate; and a hole provided in the holding portion, wherein the hole is disposed at a position where the second projected portion engages with the hole when the flag portion is positioned between the light emitting portion and the light receiving portion with respect to the longitudinal direction by movement of the holding portion in the predetermined direction by guidance of the slit portion and the first projected portion, wherein when the position of the holding portion with respect to the height direction is regulated by the second projected portion in contact with the holding portion, in a projection plane in which the outside of the first supporting side plate is viewed in the longitudinal direction from a position between the light emitting portion and the receiving portion with respect to the longitudinal direction, the flag portion is accommodated inside the opening and is in a non-overlapping position with the detecting portion, and wherein when the projected portion is engaged in the hole, in the projection plane, the flag portion is in an overlapping position with the detecting portion.

According to another aspect of the present invention, there is provided an image forming apparatus comprising: an image forming portion configured to form a toner image on a recording material; first and second rotatable members configured to feed the recording material through a nip therebetween; a movable member movable by arrival of the recording material at a predetermined position which is downstream of the nip with respect to a recording material feeding direction and which is within a passing region in which the recording material is passable with respect to a longitudinal direction of the first rotatable member, wherein the movable member includes a contact portion contactable to the recording material being in the predetermined position and includes a flag portion movable together with movement of the contact portion by the recording material contacting the contact portion; a first supporting side plate positioned outside the passing region with respect to the longitudinal direction and configured to rotatably support the first rotatable member, wherein the first supporting side plate including an opening having such a size that the flag portion is passable; a second supporting side plate positioned opposite from the first supporting side plate sandwiching the passing region therebetween with respect to the longitudinal direction and configured to rotatably support the first supporting side plate; a detecting portion including a light emitting portion and a light receiving portion and configured to detect the flag portion movable between the light emitting portion and the light receiving portion, wherein the detecting portion is positioned in an outside of the first supporting side plate with respect to the longitudinal direction, the outside being opposite from the passing region sandwiching the first supporting side plate between itself and the passing region with respect to the longitudinal direction; a supporting plate extending in the longitudinal direction so as to be connected with the first and second supporting side plates; a holding portion holding the movable member, wherein in a state that the holding portion holds the movable member, the holding portion is assembled with the supporting plate connected with the first and second supporting side plates; a slit portion configured to guide movement of the holding portion in a predetermined direction from the passing region toward the opening of the first supporting side plate so that the flag portion passes from the passing region through the opening in an assembling operation in which the holding portion is assembled with the supporting plate; a first projected portion configured to guide the movement of the holding portion in the predetermined direction in engagement with the slit; a second projected portion provided on the holding portion, wherein the second projected portion regulates a position of the holding portion relative to the supporting plate with respect to a height direction in contact with the supporting plate when the holding portion is moved in the predetermined direction by being guided by the slit portion and the first projected portion, the height direction being perpendicular to a holding portion supporting surface of the supporting plate; and a hole provided in the supporting plate, wherein the hole is disposed at a position where the second projected portion engages with the hole when the flag portion is positioned between the light emitting portion and the light receiving portion with respect to the longitudinal direction by movement of the holding portion in the predetermined direction by guidance of the slit portion and the first projected portion, wherein when the position of the holding portion with respect to the height direction is regulated by the second projected portion in contact with the supporting plate, in a projection plane in which the outside of the first supporting side plate is viewed in the longitudinal direction from a position between the light emitting portion and the receiving portion with respect to the longitudinal direction, the flag portion is accommodated inside the hole and is in a non-overlapping position with the detecting portion, and wherein when the projected portion is engaged in the hole, in the projection plane, the flag portion is in an overlapping position with the detecting portion.

According to a further aspect of the present invention, there is provided an image forming apparatus comprising: an image forming portion configured to form a toner image on a recording material; first and second rotatable members configured through a nip therebetween; a movable member movable by arrival of the recording material at a predetermined position which is downstream of the nip with respect to a recording material feeding direction and which is within a passing region in which the recording material is passable with respect to a longitudinal direction of the first rotatable member, wherein the movable member includes a contact portion contactable to the recording material being in the predetermined position and includes a flag portion movable together with movement of the contact portion by the recording material contacting the contact portion; a first supporting side plate positioned outside the passing region with respect to the longitudinal direction and configured to rotatably support the first rotatable member, wherein the first supporting side plate including an opening having such a size that the flag portion is passable; a second supporting side plate positioned opposite from the first supporting side plate sandwiching the passing region therebetween with respect to the longitudinal direction and configured to rotatably support the first supporting side plate; a detecting portion including a light emitting portion and a light receiving portion and configured to detect the flag portion movable between the light emitting portion and the light receiving portion, wherein the detecting portion is positioned in an outside of the first supporting side plate with respect to the longitudinal direction, the outside being opposite from the passing region sandwiching the first supporting side plate between itself and the passing region with respect to the longitudinal direction; a supporting plate extending in the longitudinal direction so as to be connected with the first and second supporting side plates; a holding portion holding the movable member, wherein in a state that the holding portion holds the movable member, the holding portion is assembled with the supporting plate connected with the first and second supporting side plates; a slit portion configured to guide movement of the holding portion in a predetermined direction from the passing region toward the opening so that the flag portion passes from the passing region through the opening in an assembling operation in which the holding portion is assembled with the supporting plate; a first projected portion configured to guide the movement of the holding portion in the predetermined direction in engagement with the slit; a second projected portion provided on the supporting plate, wherein the second projected portion regulates a position of the holding portion relative to the supporting plate with respect to a height direction in contact with the holding portion when the holding portion is moved in the predetermined direction by being guided by the slit portion and the first projected portion, the height direction being perpendicular to a holding portion supporting surface of holding portion; and a hole provided in the supporting plate, wherein the hole is disposed at a position where the second projected portion engages with the hole when the flag portion is positioned between the light emitting portion and the light receiving portion with respect to the longitudinal direction by movement of the holding portion in the predetermined direction by guidance of the slit portion and the first projected portion, wherein when the position of the holding portion with respect to the height direction is regulated by the second projected portion in contact with the holding portion, in a projection plane in which the outside of the first supporting side plate is viewed in the longitudinal direction from a position between the light emitting portion and the receiving portion with respect to the longitudinal direction, the flag portion is accommodated inside the opening and is in a non-overlapping position with the detecting portion, and wherein when the projected portion is engaged in the hole, in the projection plane, the flag portion is in an overlapping position with the detecting portion.

Further features of the present invention will become apparent from the following description of exemplary embodiments with reference to the attached drawings.

Figure 3:
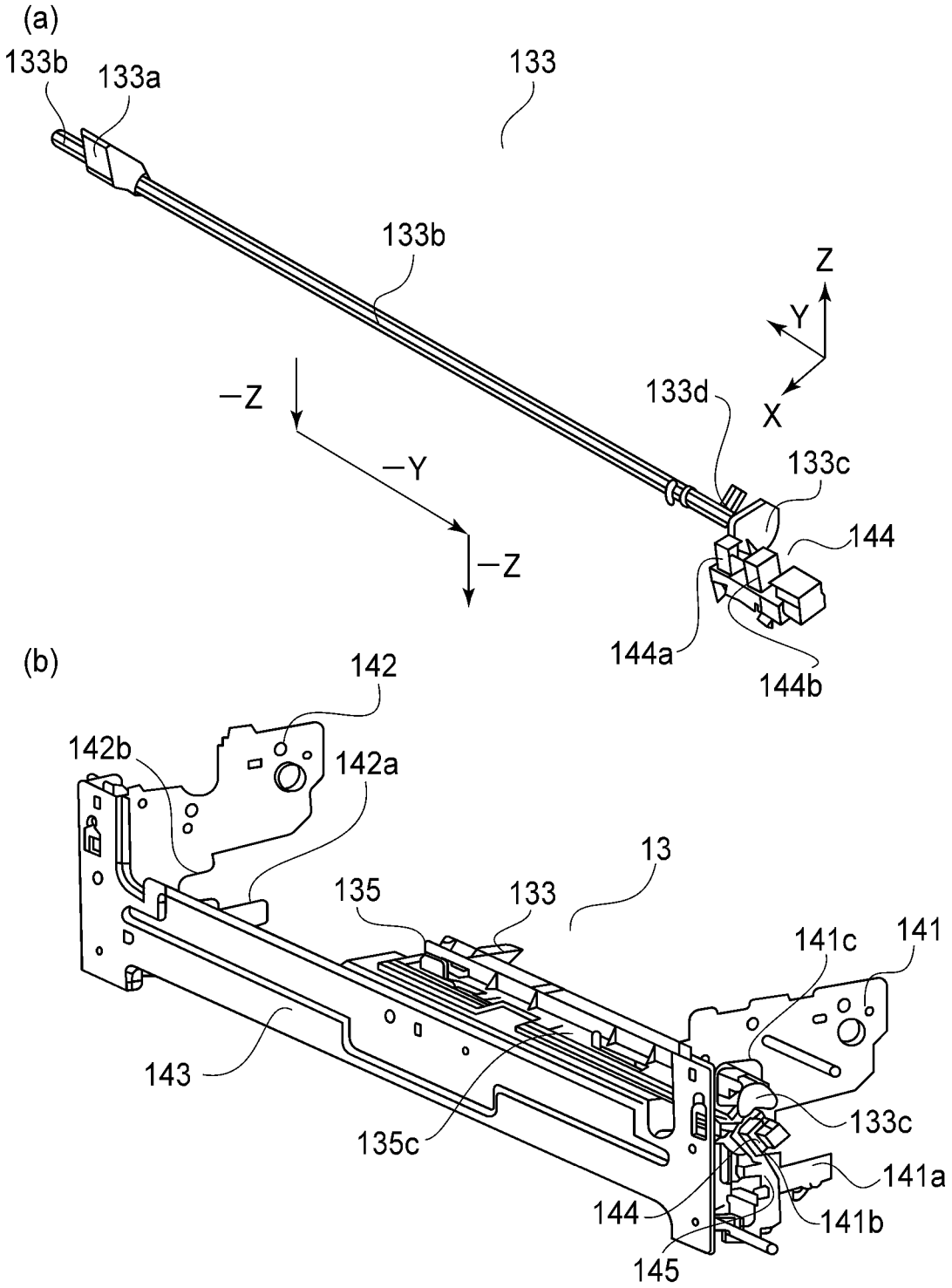

Part (a) of FIG. 3 is a perspective view showing a sensor flag in First Embodiment, and part (b) of FIG. 3 is a perspective view of a state in which a sensor unit in First Embodiment is assembled.

Figure 4:
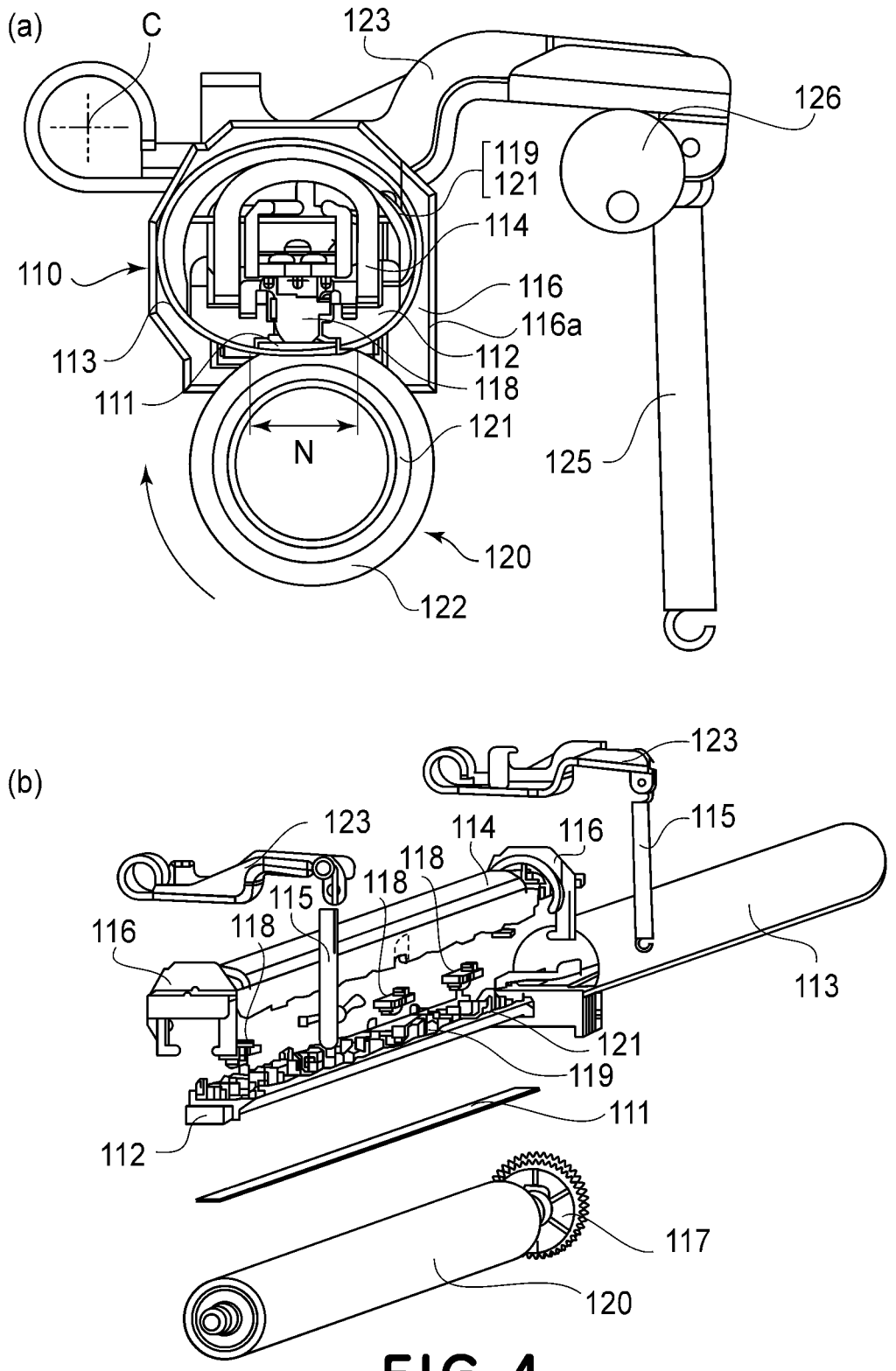

Part (a) of FIG. 4 is a sectional view showing an inside of the fixing device in First Embodiment, and part (b) of FIG. 4 is an exploded view showing the inside of the fixing device in First Embodiment.

Figure 5:
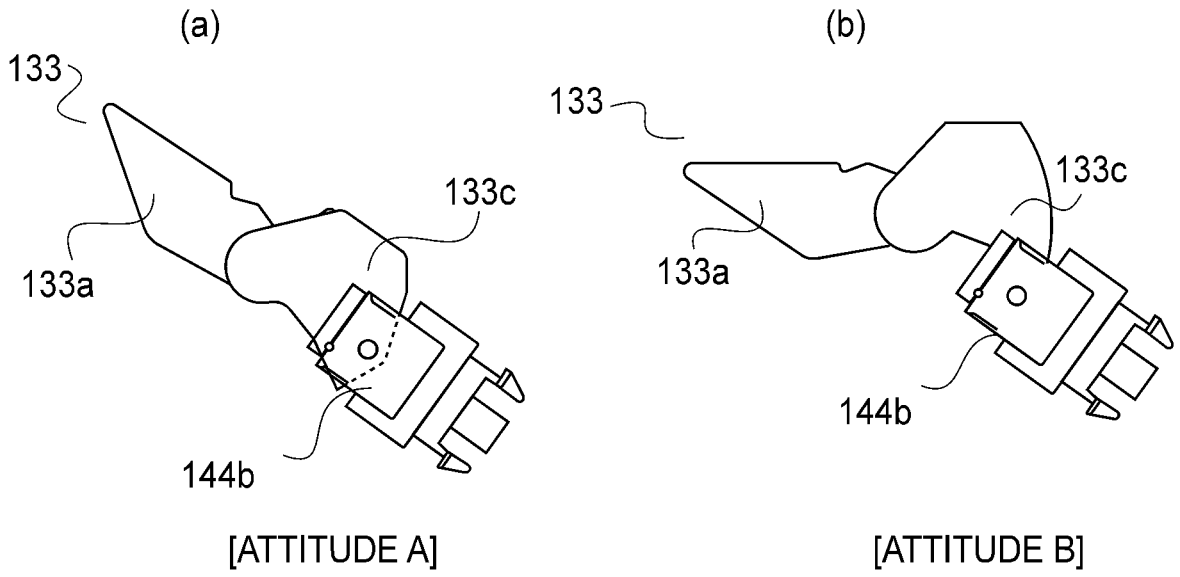

Parts (a) and (b) of FIG. 5 are side views showing the sensor flag in First Embodiment in the case of presence and absence of paper (recording material), respectively.

Figure 6:
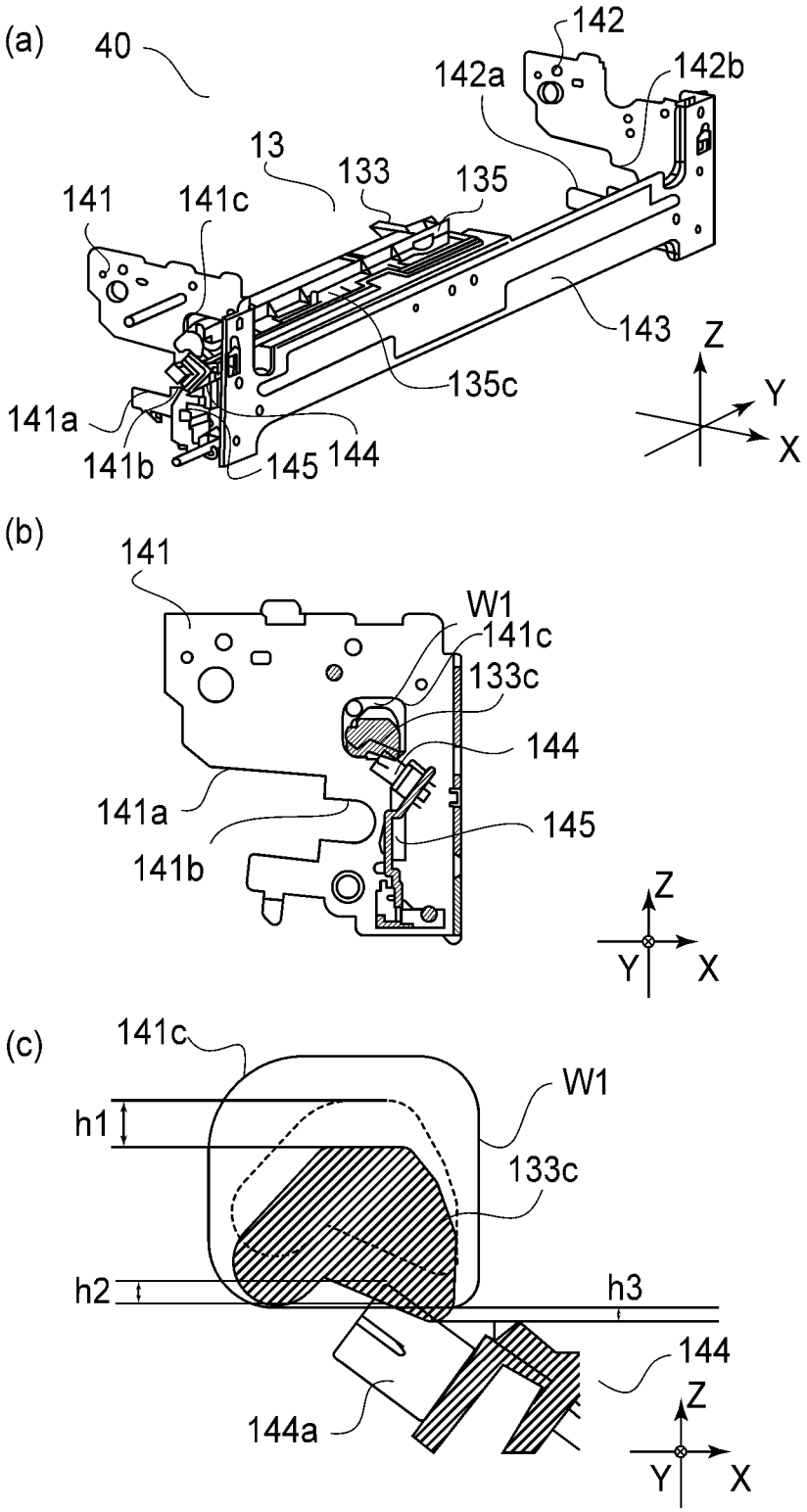

Parts (a), (b) and (c) of FIG. 6 are a perspective view, a sectional view and an enlarged view, respectively, of a state in which the sensor unit in First Embodiment is assembled.

Figure 7:
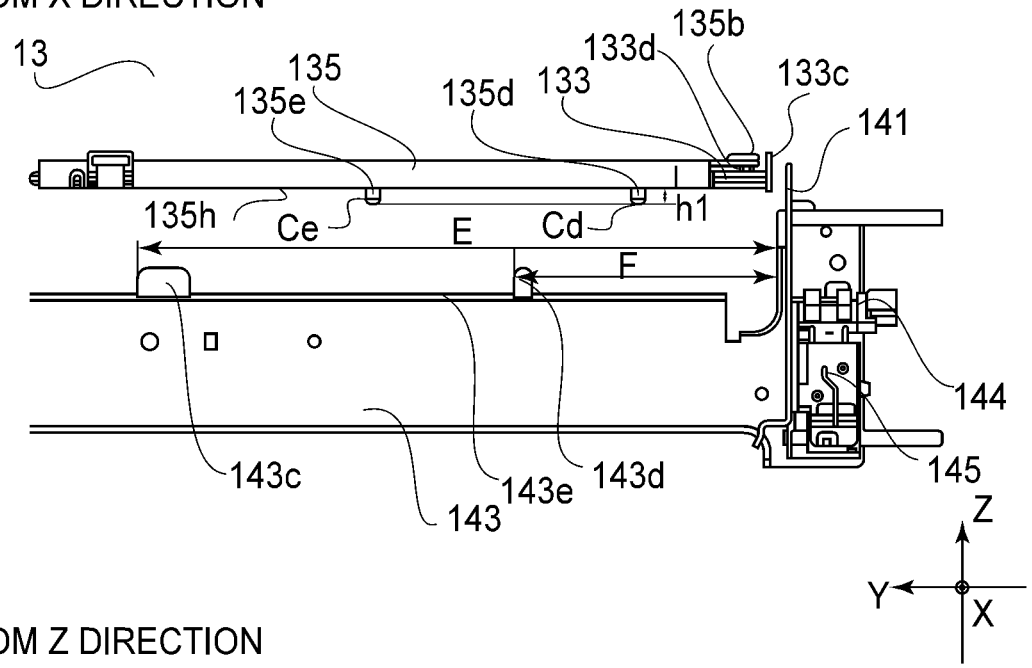
Figure 7:
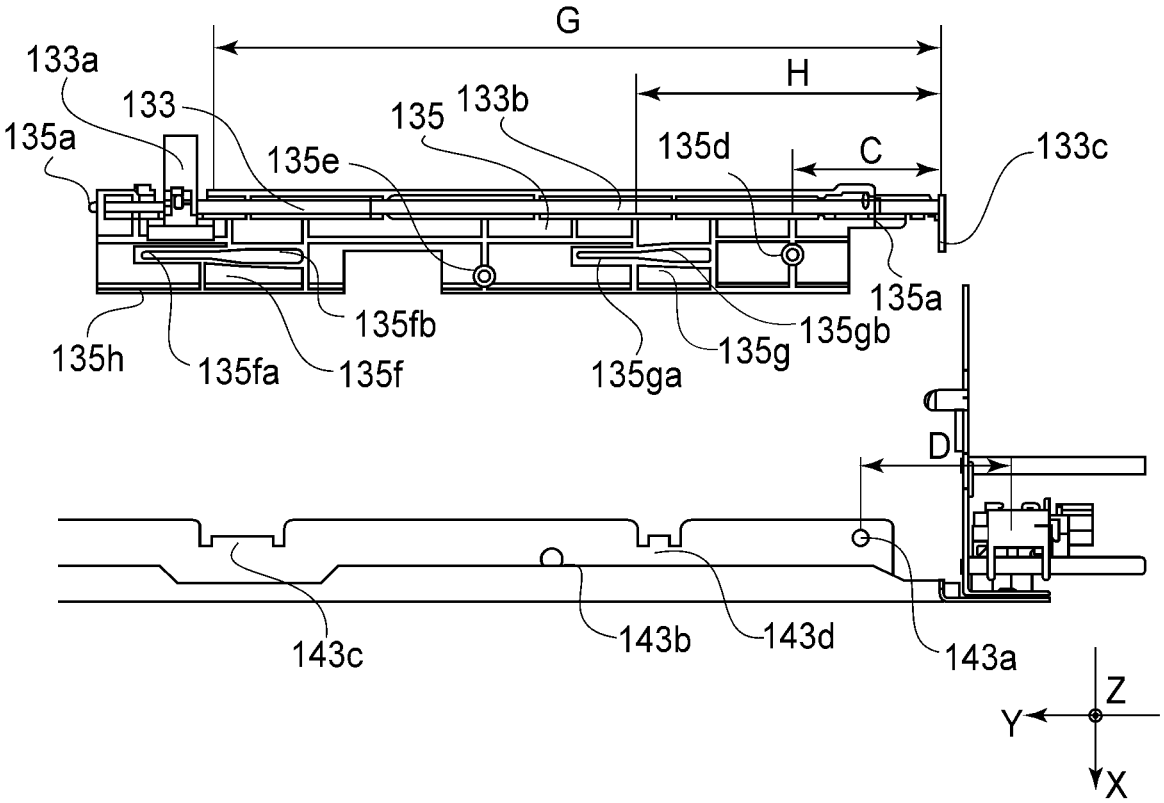

Parts (a) and (b) of FIG. 7 are schematic views of a state in which the sensor unit in First Embodiment is disassembled, as seen in an X direction and a Z direction, respectively.

Figure 8:
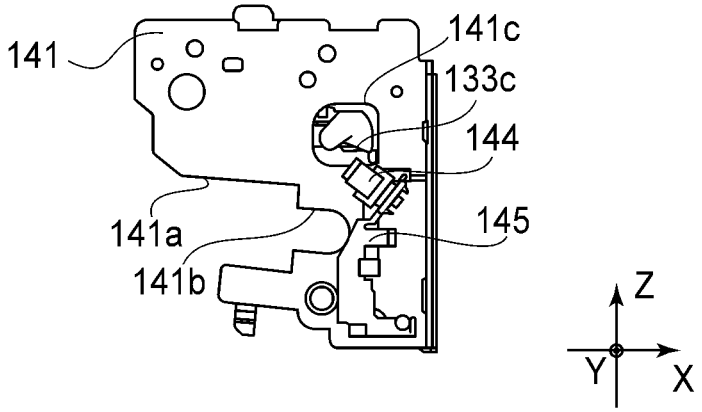
Figure 8:
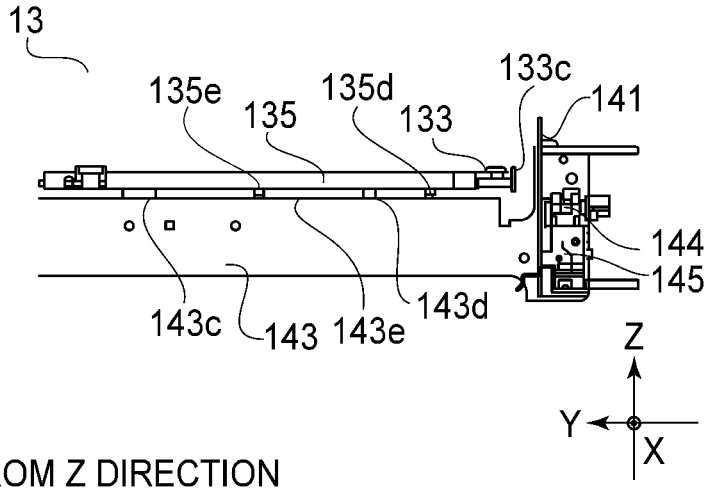
Figure 8:
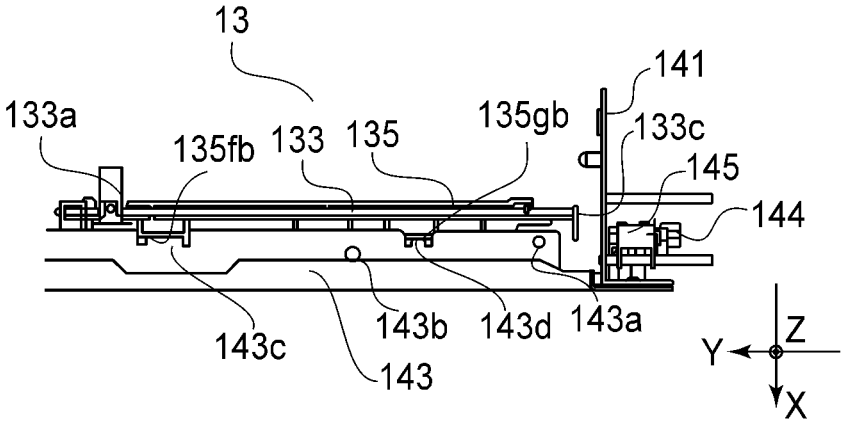

Parts (a), (b) and (c) of FIG. 8 are schematic views of an assembling step of the sensor unit in First Embodiment (assembling start state).

Figure 9:
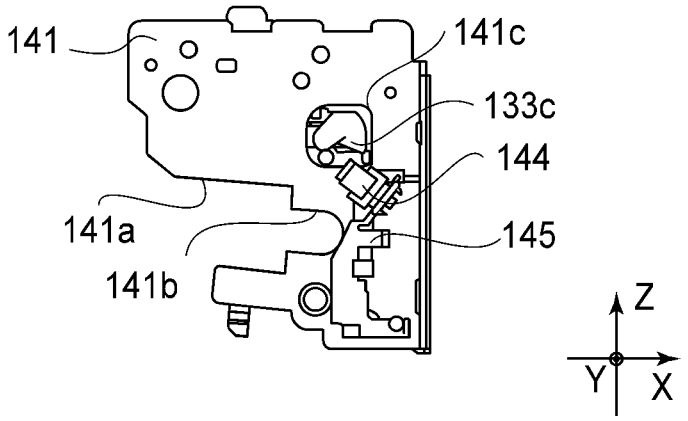
Figure 9:
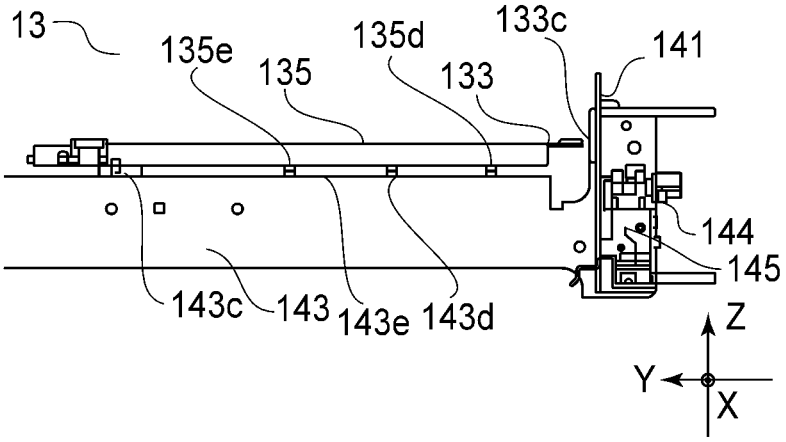
Figure 9:
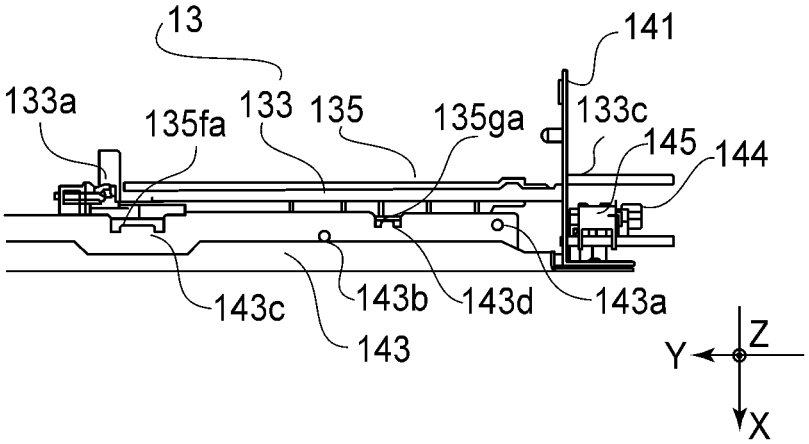

Parts (a), (b) and (c) of FIG. 9 are schematic views of the assembling step of the sensor unit in First Embodiment (x direction regulation toner).

Figure 10:
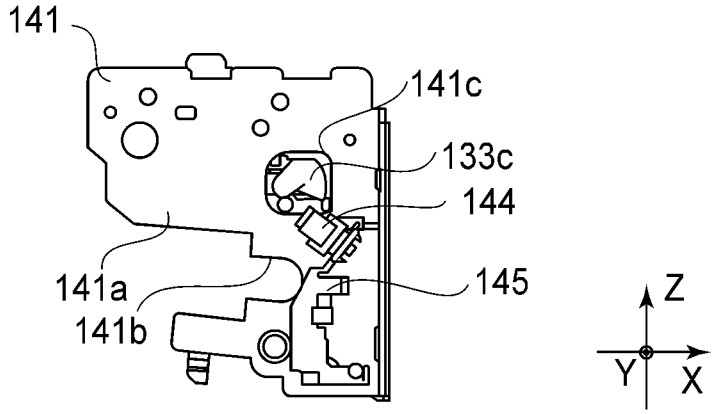
Figure 10:
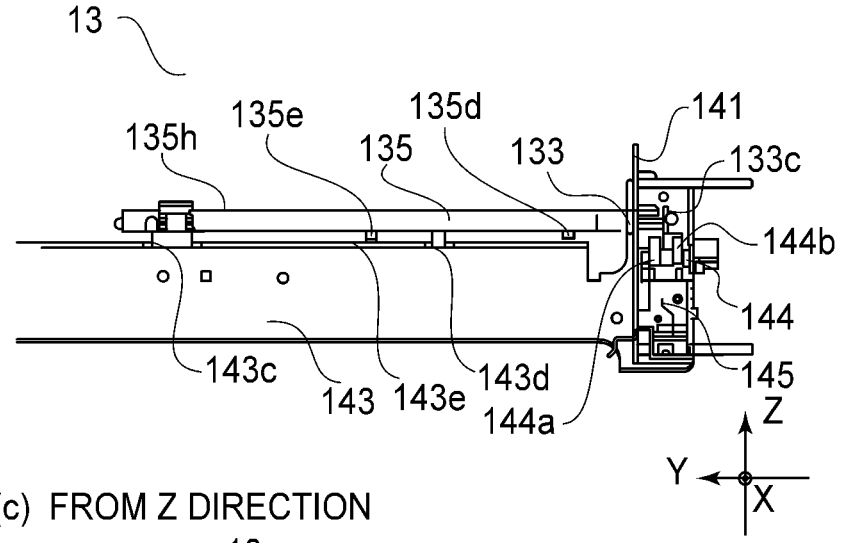
Figure 10:
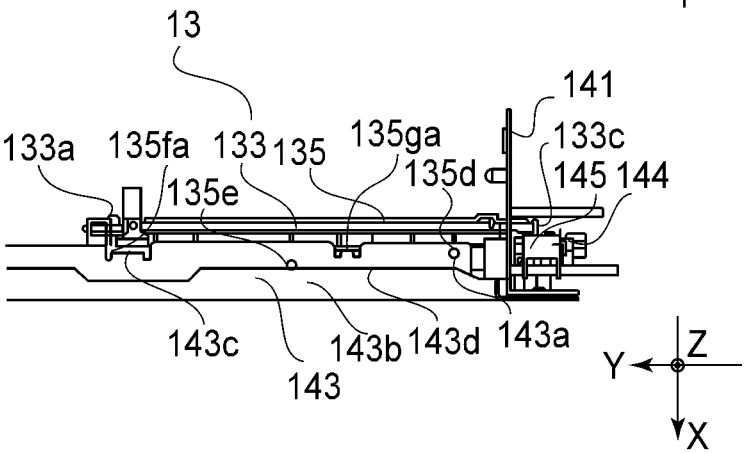

Parts (a), (b) and (c) of FIG. 10 are schematic views of the assembling step of the sensor unit in First Embodiment (opening passing state of front side plate).

Figure 11:
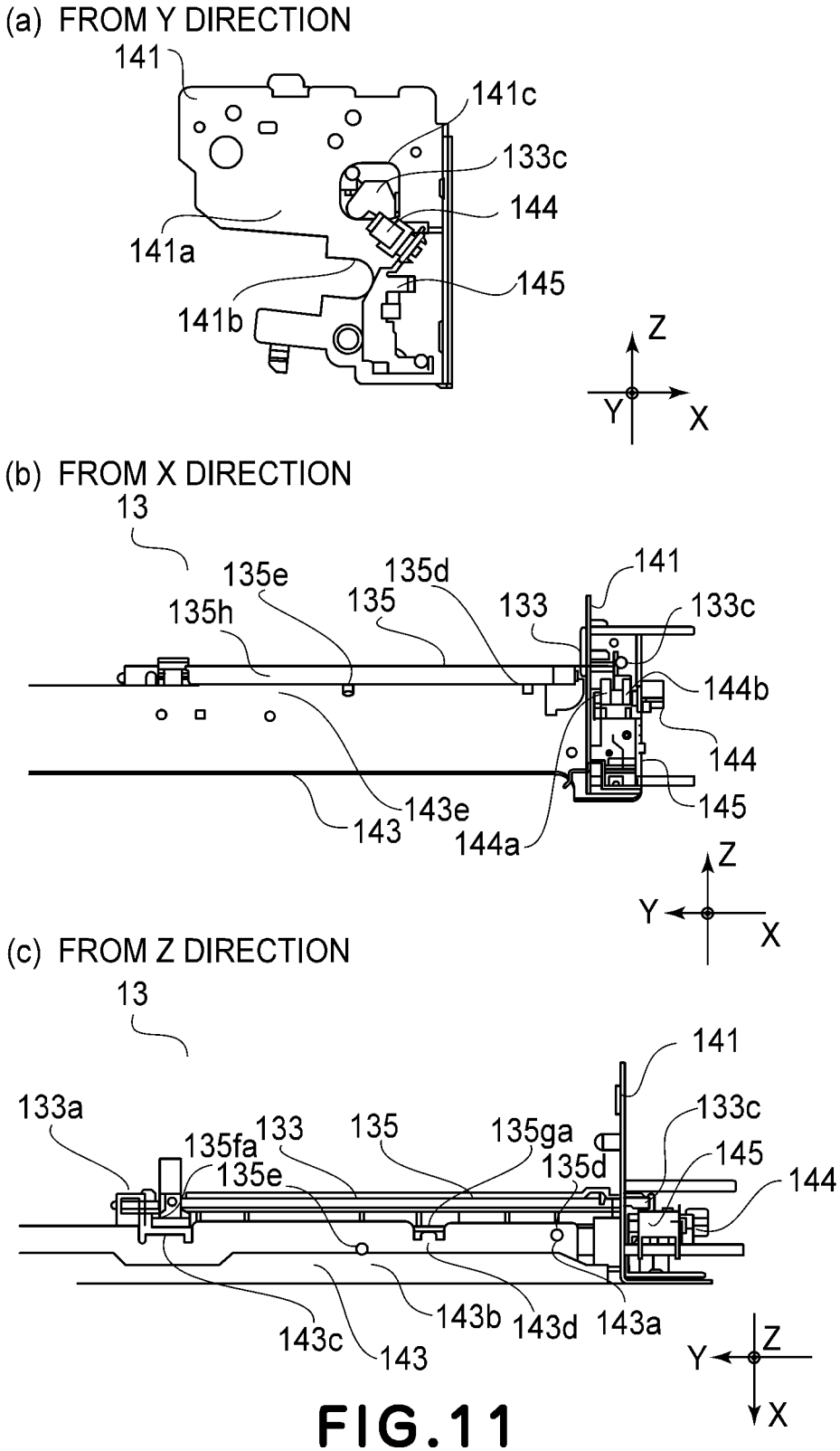

Parts (a), (b) and (c) of FIG. 11 are schematic views of the assembling step of the sensor unit in First Embodiment (assembling completion state).

DESCRIPTION OF THE EMBODIMENTS

Embodiments of the present invention will be specifically described with reference to the drawings.

First Embodiment (Image Forming Apparatus)

Figure 1:
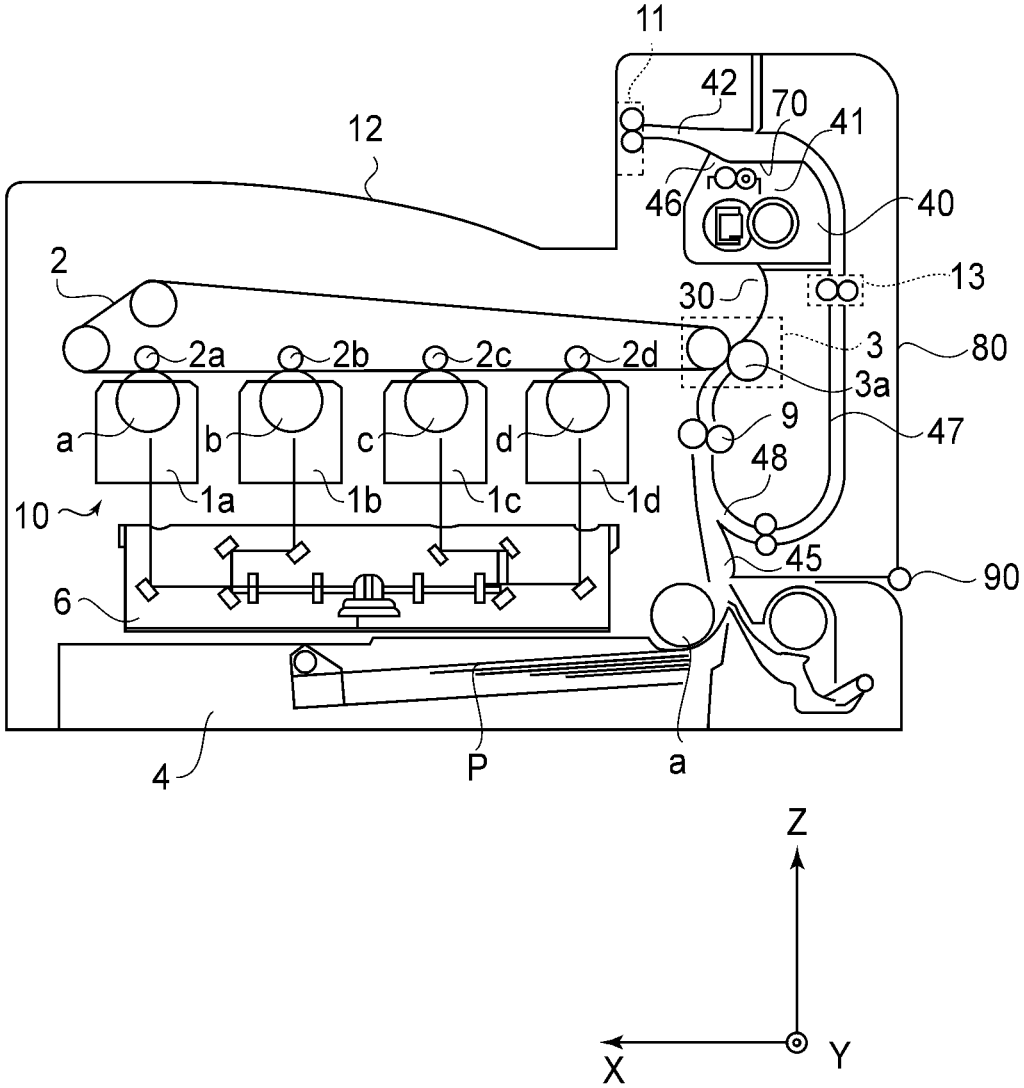
FIG. 1 is a schematic view showing a general structure of an image forming apparatus in which a fixing device according to First Embodiment of e present invention is mounted.

FIG. 1 shows a tandem-type full-color printer as an image forming apparatus in which a fixing device including a sensor flag adjusting unit according to this embodiment of the present invention is mounted, and is a schematic sectional view of the printer along a feeding direction of a recording material P. On the recording material P, a toner image is formed by an image forming portion.

The printer shown in FIG. 1 includes the image forming portion 10 for respective colors of Y (yellow), M (magenta), C (cyan) and Bk (black). Photosensitive drums a-d of image forming units 1*a*-1*d* are electrically charged in advance by chargers, and thereafter, latent images are formed by a laser scanner 6. The latent images are developed into toner images by developing devices. The toner images on the photosensitive drums a-d are successively transferred onto, for example, an intermediary transfer belt 2 which is an image bearing member by primary transfer rollers 2*a*-2*d*.

On the other hand, the recording material P is fed one by one from a state feeding cassette 4 and passes through a post-sheet feeding path 45, and is sent to a registration roller pair 9. The registration roller pair 9 once receives the recording material P, and in the case where the recording material P obliquely moves, the registration roller pair 9 rectifies the oblique movement of the recording material P so as to move straight. Then, the registration roller pair 9 sends the recording material P to between the intermediary transfer belt 2 and a secondary transfer roller 3*a* in synchronism with the toner images on the intermediary transfer belt 2.

The toner images on the intermediary transfer belt 2 are transferred onto the recording material P by, for example, the secondary transfer roller 3*a* which is a transferring member. Thereafter, the toner images on the recording material P pass through a pre-fixing feeding path 30, and the recording material P is heated and pressed by a fixing device 40, so that the toner images are fixed on the recording material P.

In the case where the toner image is formed on only one surface of the recording material P, the recording material P is discharged onto a sheet discharge tray 12 through a sheet discharging roller pair 11 by switching of a switching flapper 46. In the case where the toner images are formed on both surfaces of the recording material P, the recording material P on which the toner image is fixed is fed in a vertical direction by the fixing device 40 and then is further fed by the sheet discharging roller pair 11. Then, when a trailing end of the recording material (paper) P reaches a reversing point 42, the recording material P is fed in a switch-back manner by reverse rotation of the sheet discharging roller pair 11.

Then, after the recording material P is passed through a feeding path 47 for double-side printing by the switching flapper 46, a process similar to that of one-side printing (image formation) is performed, so that the toner image is formed on the other surface (side) of the recording material P and then the recording material P is discharged onto the sheet discharge tray 12. Incidentally, a portion constituted by the flapper 46 and the sheet discharging roller pair 11 which are used in a switch-back operation is an example of a reversing means.

For the purposes of removal of the recording material P during a jam in the feeding path and of maintenance and the like, an apparatus main assembly is provided with a door 80 so as to be rotatable about a hinge 90 toward a right side in FIG. 1. The pre-fixing feeding path 30, the secondary transfer roller 3*a* and one (right-side of FIG. 1) of the registration roller pair 9 are provided on the door 80 side, and when the door 80 opens, a feeding path other than the fixing device 40 is open in a region from the post-sheet feeding path 45 to the sheet discharging roller pair 11.

(Fixing Device)

Figure 2:
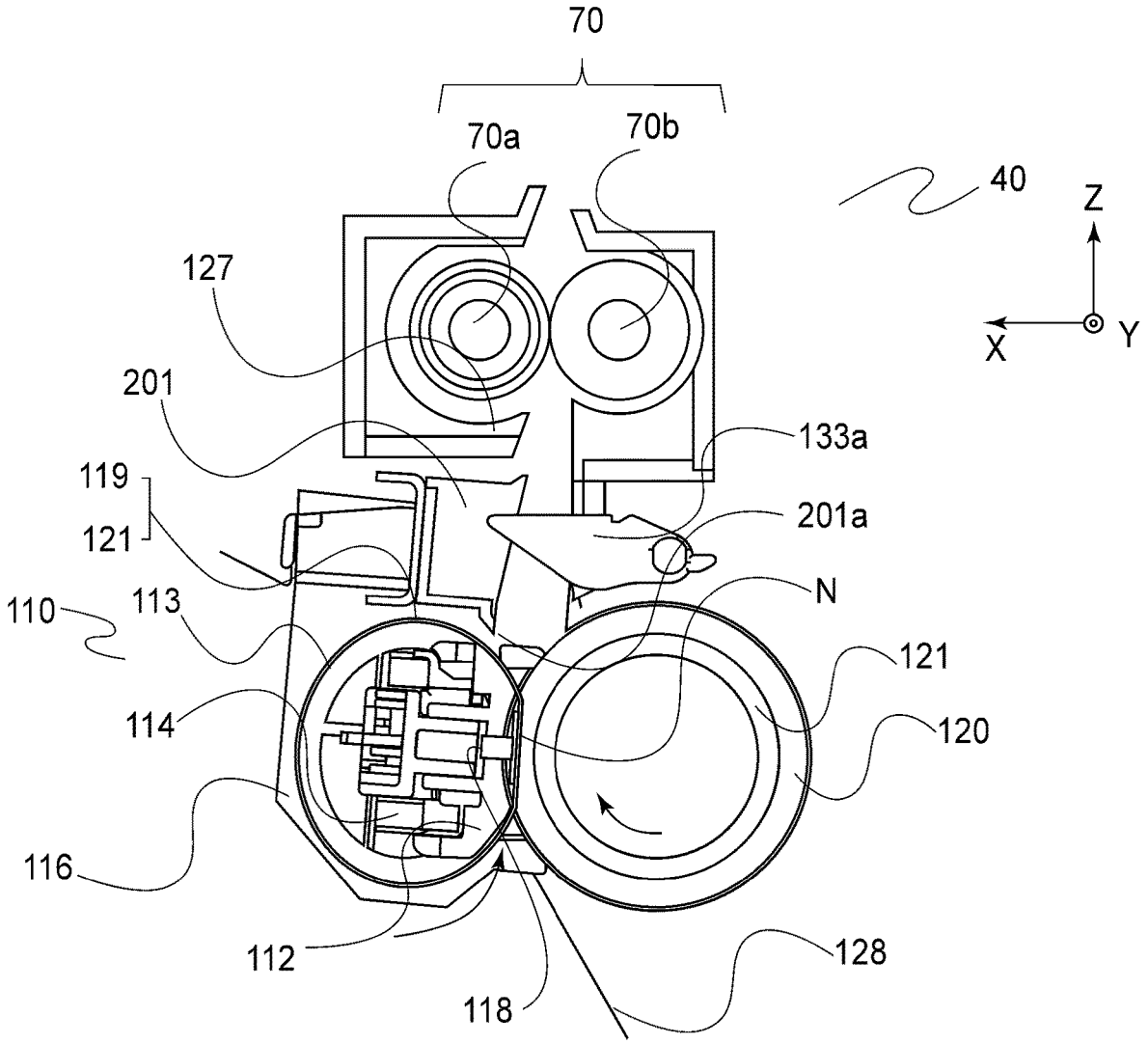
FIG. 2 is a sectional view showing a feeding portion of the fixing device including a sensor flag adjusting unit in First Embodiment.

FIG. 2 is a sectional view showing a feeding portion of the fixing device 40 including the sensor flag adjusting unit in this embodiment of the present invention. Part (a) of FIG. 4 is a sectional view showing an inside of the fixing device 40, and part (b) of FIG. 4 is an exploded view showing the inside of the fixing device 40. A heating device 110 provided in the fixing device 40 shown in FIG. 2 is urged against elasticity of a pressing roller 120 by the following constitution, so that a fixing nip N is formed. The heating device 110 includes flanges 116 at both end portions thereof with respect to a direction perpendicular to the drawing sheet, and the flanges 116 are connected with a metal stay 114.

An urging (pressing) spring 115 (FIG. 4) is connected at one end with an unshown fixing device casing and is connected at the other end with an urging (pressing) arm 123 (FIG. 4). The urging arm 123 is held rotatably about a rotation center C ((a) of FIG. 4), and one end of the urging arm 123 is urged by the urging spring 115, so that the urging arm 123 imparts an urging force to the flanges 116. Thus, the flanges 116 are urged in a direction of the pressing roller 120.

That is, the urging force transmitted to the flanges 116 acts on both end portions of the metal stay 114 ((b) of FIG. 4), with the result that the metal stay 114 is urged in the direction of the pressing roller 120. As a result, a heat-resistant holder 112 provided in contact with the metal stay 114 and a heater 111 provided in contact with the heat-resistant holder 112 are assembled together as a unit and are urged in the direction of the pressing roller 120.

That is, as shown in (b) of FIG. 4, the metal stay 114 projects at both longitudinal ends thereof from the heat-resistant holder 112 and are inserted into the flanges 116, so that the urging arms 123 provided on the flanges 116 are urged by the urging springs 115. A load is uniformly transmitted to the heat-resistant holder 112 over a longitudinal direction via the stay 114.

At the fixing nip N, a fixing film 113 as a rotatable member is flexed by being sandwiched between the heater 111 and the pressing roller 120 as an opposing member (rotatable member) by a pressing force, so that the fixing film 113 is in a state of hermetic contact with a heating surface of the heater 111. The pressing roller 120 receives a driving force, from an unshown motor, for rotating the pressing roller 120 in a direction of an arrow in (a) of FIG. 4 by a driving gear 117 ((b) of FIG. 4) provided at an end portion of a core metal thereof. By the drive of the pressing roller 120, the recording material P fed in the fixing nip N is controlled so as to receive a feeding force providing a speed PS.

With this rotational drive of the pressing roller 120, the fixing film 113 is rotated (moved) by a frictional force with the pressing roller 120. At this time, the fixing film 113 slides on the heater 111. Between the fixing film 113 and the heater 111, a lubricant such as a heat-resistant grease of a fluorine-containing type or a silicone type is interposed, whereby a frictional resistance is suppressed to a low level, so that the fixing film 113 is smoothly rotatable (movable).

Further, temperature control of the heater 111 is carried out depending on signals of a through detecting element such as a thermistor 118 or the like provided on a back surface of a ceramic substrate thereof and a temperature detecting element such as a thermistor 119 or the like provided, for directly detecting a temperature of the fixing film 113, on an inner surface of the fixing film 113. That is, an unshown heater controller determines and properly controls a duty ratio, a wave number and the like of a voltage applied to an energization heat generating resistance layer, whereby a temperature in the fixing nip N is maintained at a predetermined set temperature.

Further, the metal stay 114 is provided with a grounding means 121 ((b) of FIG. 4) is used for ensuring a ground for the fixing film 113. The grounding means 121 and the thermistor 119 are mounted so that free ends thereof project with a spring property on an outside of a projection shape during mounting of the fixing film 113 in a natural state so that the free ends slide on and contact the inner surface of the fixing film 113 in a state in which the fixing film 113 is mounted.

The fixing device 40 includes an inner sheet discharging roller pair (feeding roller pair) 70 as shown in FIG. 2. The inner sheet discharging roller pair 70 is constituted by an inner sheet discharging driving roller 70*a* and an inner sheet discharging driven roller 70*b*. To the inner sheet discharging driving roller 70*a*, an unshown driving gear is provided at an end portion with respect to a direction perpendicular to the drawing sheet and a driving force is inputted from an unshown driving source. The inner sheet discharging driven roller 70*b* is urged against the inner sheet discharging driving roller 70*a* by an unshown urging means, so that a nip is formed therebetween and the recording material P is fed through the nip.

In order to suitably maintain an attitude of the fed recording material P, the inner sheet discharging driving roller 70*a* is rotated at a speed set so as to be higher, for example, about 0-5% than a rotational speed of the pressing roller 120. The inner sheet discharging roller pair 70 may desirably be brought near to the fixing nip N to the extent possible. This is because the recording material P discharged from the fixing nip N is maintained early in a suitable attitude to the extent possible and thus a product quality is improved.

Further, inside the fixing device 40, a sheet discharge sensor (sensor flag, movable member) 133 including a flag portion 133*c* described later is provided. The sheet discharge sensor 133 is, as shown in FIG. 2, provided between the fixing nip N and the nip of the inner sheet discharging roller pair 70 with respect to the feeding direction of the recording material P. With respect to the feeding direction of the recording material P, the inner sheet discharging roller pair 70 is a roller pair positioned downstream of the fixing nip N and configured to subsequently nip the recording material P discharged from the fixing nip N. The sheet discharge sensor 133 detects whether or not the recording material P discharged from the fixing nip N is properly fed. Then, the sheet discharge sensor also performs a function of discriminating whether or not the recording material P is removed when the recording material P jams on a side downstream of the fixing nip N in the fixing device 40 with respect to the feeding direction (remaining sheet (paper) detection.

The recording material P on which an unfixed toner image is held is appropriately fed along an entrance guide 128 (FIG. 2) by an unshown feeding means at predetermined timing, so that a heat-fixing of the unfixed toner image is carried out in the fixing nip N while nipping and feeding the recording material P through the fixing nip N. The recording material P discharged from the fixing nip N is guided by a separation guide 201 and then is guided by a sheet discharging guide 127 provided downstream of the separation guide 201 with respect to the feeding direction, and thus is fed to the inner sheet discharging roller pair 70.

(Sheet Discharging Sensor)

The sheet discharge sensor (sensor flag) 133 in this embodiment will be specifically described with reference to parts (a) and (b) of FIG. 3, parts (a) and (b) of FIG. 5 and part (a) of FIG. 6. Part (a) of FIG. 3 is a perspective view showing the sheet discharge sensor 133 and a photosensor 144, and part (b) of FIG. 3, parts (a) and (b) of FIG. 5 and part (a) of FIG. 6 are schematic views showing a relationship between the sheet discharge sensor 133 and the sensor holder 135.

In this embodiment, as shown in part (a) of FIG. 3, detection of the recording material P is carried out by the sheet discharge sensor 133 and the photosensor 144 as a detecting portion for detecting a phase of the sheet discharge sensor. The photosensor 144 is a photosensor of a (light-) transmission type and a light emitting portion 144*b* and a sensor portion (light receiving portion) 144*a* including a light receiving element for receiving incident light from the light emitting portion 144*b*. The sheet discharge sensor 133 includes a sheet discharge sensor contact portion 133*a* where the recording material P reaches and contacts and includes a portion-to-be-held 133*b* rotatably supported by a holding portion 135*a* of a sheet discharge sensor holder 135. Thus, the sheet discharge sensor 133 is rotatably held by the sheet discharge sensor holder 135. The sheet discharge sensor contact portion 133*a* contacts the recording material P reached a predetermined position. The predetermined position is between the fixing nip N and the nip of the inner sheet discharging roller pair 70 with respect to the feeding direction of the recording material P and is in a (sheet) passing region, with respect to a longitudinal direction of the pressing roller 120 (also the longitudinal direction of the fixing film 113), where the recording material P is passable.

The sheet discharge sensor 133 further includes a sheet discharge sensor flag portion 133*c* for blocking the incident light into the sensor portion 144*a* of the photosensor 144 by rotation. In addition, the sheet discharge sensor 133 includes an abutting portion 133*d* of which rotation attitude is regulated by being abutted against an abutting portion 135*b* ((a) of FIG. 7) of the sheet discharge sensor holder 135.

In this embodiment, as shown in parts (a) and (b) of FIG. 5, a state in which the flag portion 133*c* light-blocks the photosensor 144 is referred to as a "recording material P presence state", and a state in which the flag portion 133*c* permits light transmission through the photosensor 144 is referred to as a "recording material P non-presence (absence) state". Further, the sheet discharge sensor 133 is urged by an unshown urging means so that the recording material P can be returned to the "recording material P non-presence state" after the recording material P passes through the sheet discharge sensor and thus is once in the "recording material P presence state".

In the case where a jam of the recording material P occurs in the fixing nip N, it is desirable that the sheet discharge sensor 133 early detects the recording material P and the fixing device is stopped due to emergency. In this embodiment, diameters of the fixing film 113 and the pressing roller 120 are set at about 30 mm, and the sheet discharge sensor 133 is disposed at a position of about 15 mm from the fixing nip N so as to be capable of detecting arrival of the recording material P.

(Sheet Discharge Sensor Unit)

Structures of the sheet discharge sensor 133 and the sheet discharge sensor holder 135 for holding the sheet discharge sensor 133 will be specifically descried using FIGS. 6 and 7. Here, a state in which the sheet discharge sensor 133, the sheet discharge sensor holder 135 and an unshown urging means are assembled (positionally adjusted) is referred to as a sheet discharge sensor unit 13.

For simplification of explanation, in the following, a pressing (urging) direction of the fixing nip N is referred to as an "X direction", a widthwise direction of the recording material P (longitudinal direction of the fixing member) is referred to as a "Y direction", and the feeding direction of the recording material P is referred to as a "Z direction".

Parts (a), (b) and (c) of FIG. 6 are schematic views showing a state in which the sheet discharge sensor unit 13 is assembled with the fixing device 40, in which part (a) of FIG. 6 is a perspective view, part (b) of FIG. 6 is a sectional view at a center of an optical axis of the photosensor 144 with respect to the Y direction, and part (c) of FIG. 6 is an enlarged view at a periphery of the photosensor 144. As shown in FIG. 6, the fixing device 40 includes a front side plate (supporting side plate) 141 and a rear side plate (supporting side plate) 142 which are used as a casing are provided at both ends thereof with respect to the widthwise direction (Y direction) of the recording material P. The front side plate 141 and the rear side plate 142 include flange holding portions 141*a* and 142*a*, respectively, for holding the flanges 116 and include pressing roller holding portions 141*b* and 142*b*, respectively, for rotatably supporting the pressing roller 120 via unshown bearings.

Further, in order to enhance strength and rigidity of the fixing device 40, a reinforcing stay (supporting plate) 143 as a casing extends in the widthwise direction (Y direction) of the recording material P and is provided between the front side plate 141 and the rear side plate 142 and is fastened by a means such as unshown screws or welding. The front side plate 141, the rear side plate 142 and the supporting plate 143 are made of a metallic material.

With the front side plate 141, the photosensor 144 mounted on a photosensor holder 145 is assembled. The photosensor 144 and the photosensor holder 145 are disposed on a side opposite from a feeding path of the recording material P with respect to the front side plate 141. This is because the influence by heat, paper powder, contamination with a wax, and the like, which generate in the fixing device 40 is reduced.

The sheet discharge sensor unit 13 is disposed so as to extend toward an outside through an opening 141*c* provided in the front side plate 141 so that the flag portion 133*c* projects on the photosensor 144 side positioned on the outside of the front side plate 141. In the sheet discharge sensor unit 13, a fixing portion 135*c* provided on the sheet discharge sensor holder 135 is fixed to the reinforcing stay 143 by an unshown fixing means such as a screw.

Detailed structures of the sheet discharge sensor unit 13 and the reinforcing stay 143 will be described with reference to FIGS. 6 and 7. Parts (a) and (b) of FIG. 7 are exploded views of the sheet discharge sensor unit 13 and the reinforcing stay 143. First, shapes will be described, and an effect of the shapes will be described later. The sheet discharge sensor holder 135 is provided with cylindrical height regulating bosses 135*d* and 135*e* are provided with respect to a-z direction (i.e., at a bottom thereof) as shown in (a) and (b) of FIG. 7. Further, on a side surface of the sheet discharge sensor holder 135, a slide assisting grooves (slit portions) 135*f* and 135*g* and an abutting surface 135*h* which extend along the Y direction. The sheet discharge sensor holder 135 is made of a resin material.

On the other hand, the reinforcing stay 143 which is the casing is provided with round holes 143*a* and 143*b* ((a) of FIG. 7) with respect to the X direction and the Y direction, slide assisting portions 143*c* and 143*d* having projected portions with respect to the Z direction, and a height regulating surface 143*e* ((a) of FIG. 7) with respect to the Z direction. In this embodiment, each of the slide assisting portions 143*c* and 143*d* has a plate shape which is thin and long in the Y direction and which has a thickness with respect to the X direction as shown in FIG. 7.

In an assembled state, the height regulating bosses 135*d* and 135*e* of the sheet discharge sensor holder 135 are disposed at positions corresponding to positioning holes 143*a* and 143*b*, respectively, as positioning portions of the reinforcing stay 143. A diameter of the positioning hole 143*a* is set so as to be larger by about several tens of μm than a diameter of the height regulating boss 135*d* and performs a function of determining a position of the sheet discharge sensor unit 13 with respect to the X direction and the Y direction when the height regulating boss 135*d* engages in the associated positioning hole 143*a*.

On the other hand, a diameter of the positioning hole 143*b* is set so as to be larger by about several mm than a diameter of the height regulating boss 135*e* and so as not to contact the height regulating boss 135*e* when the height regulating boss 135*e* engages in the associated positioning hole 143*b* ((c) of FIG. 10, (c) of FIG. 11).

At free end portions of the height regulating bosses 135*d* and 135*e*, as shown in part (a) of FIG. 7, tapered portions Cd and Cd for guiding the height regulating bosses 135*d* and 135*e*, respectively, are provided. Therefore, each of the height regulating bosses 135*d* and 135*e* is configured so that a diameter thereof decreases from a base portion (abutting surface 135*h* side) toward a free end. Incidentally, the tapered portions Cd and Ce of the height regulating bosses 135*d* and 135*e* may also be provided from intermediary portions of the height regulating bosses 135*d* and 135*e*. That is, a constitution in which the diameter of each of the height regulating bosses 135*d* and 135*e* is such that the diameter is substantially the same from the base portion (abutting surface 135*h* side) to the intermediary portion and decreases from the intermediary portion toward the free end may also be employed. Also in this constitution, the diameter of the height regulating boss on the free end side is smaller than the diameter of the height regulating boss on the base portion side.

Further, in part (c) of FIG. 6, a height h1 of each of the height regulating bosses 135*d* and 135*e* is larger (higher) than heights h2 and h3 in an assembled state when the flag portion 133*c*, the photosensor 144 and the opening 141*c* of the front side plate 141 are projected on an X-Z plane. That is, the height h1 is set so as to be larger than the height h2 in which the flag portion 133*c* and the photosensor 144 overlap with each other with respect to the Z direction and be larger than the height h3 in which the flag portion 133*c* and the opening 141*c* of the front side plate 141 overlap with each other with respect to the Z direction. That is, the opening 141*c* has a size permitting displacement of the sensor flag adjusting unit in −Z direction (third direction).

Further, as shown in part (c) of FIG. 6, an opening amount W1 of the opening 141*c* of the front side plate 141 is determined so that a projection portion obtained by projecting the flag portion 133*c* on the X-Z plane when the flag portion 133*c* moves from the assembled state in the Z direction by the height h1 is avoided.

Further, as shown in (b) of FIG. 7, a distance C from a center of the height regulating boss 135*d* and the flag portion 133*c* with respect to the Y direction is set so as to be substantially equal to a distance D from a center of the positioning hole 143*a* of the reinforcing stay 143 to a center of an optical axis portion of the photosensor 144 with respect to the Y direction.

(Slide (Movement) of Sheet Discharge Sensor Holder 135)

Side (movement) of the sheet discharge sensor holder 135 will be described. The slide assisting grooves 135*f* and 135*g* of the sheet discharge sensor holder 135 are provided correspondingly to the slide assisting portions 143*c* and 143*d* of the reinforcing stay 143 and is constituted so as to be slidable (movable) in the Y direction. That is, the reinforcing stay 143 as the casing includes the slide assisting portions 143*c* and 143*d* as portions-to-be-regulated correspond to the slide assisting grooves 135*f* and 135*g* as first regulating portions, respectively.

Specifically, as shown in part (b) of FIG. 7, a width of the slide assisting groove 135*f* with respect to the X direction is set so as to be larger by about several tens of μm than a width of the slide assisting portion 143*c* with respect to the X direction. Further, a slide assisting groove-roughly guide portion (guiding groove portion) 135*fb* as a first region and a slide assisting groove-positioning portion (positioning groove portion) 135*fa*, as a second region, for regulating rotation of the sheet discharge sensor holder 135 in X-Y direction in the assembled state are successively provided along the Y direction. The guiding groove portion 135*fb* is set so as to be larger by about several mm than the width of the slide assisting portion 143*c* with respect to the X-direction, so that guidance of the slide assisting portion into the positioning groove portion 135*fa* is prompted.

Thus, the slide assisting groove 135*f* successively includes the first region (135*fb*) for regulating the sheet discharge sensor holder 135 with first accuracy and the second region (135*fa*) for regulating the sheet discharge sensor holder 135 with second accuracy higher than the first accuracy.

Further, a width of the slide assisting groove 135*g* with respect to the X direction is set so as to be larger by about several hundreds of μm than a width of the slide assisting portion 143*d* with respect to the X direction. Further, during assembling, the slide assisting groove 135*g* is constituted by a slide assisting groove-positioning portion (positioning groove portion) 135*ga*, for regulating rotation of the sheet discharge sensor holder 135 in X-Y direction with a latitude and by a slide assisting groove-roughly guide portion (guiding groove portion) 135*gb*. The guiding groove portion 135*gb* is set so as to be larger by about several mm than the width of the slide assisting portion 143*c* with respect to the X-direction, so that guidance of the slide assisting portion into the positioning groove portion 135*ga* is prompted.

Thus, the slide assisting groove 135*g* successively includes the first region (135*gb*) for regulating the sheet discharge sensor holder 135 with first accuracy and the second region (135*ga*) for regulating the sheet discharge sensor holder 135 with second accuracy higher than the first accuracy.

Here, in the slide (movement) of the sheet discharge sensor holder 135 in the −Y direction, when the flag portion 133*c* passes through the opening 141*c* of the front side plate 141 and the photosensor 144, attitudes of the sheet discharge sensor holder 135 and the sheet discharge sensor 133 may desirably be stable in a regulated state.

Therefore, when the flag portion 133*c* passes through the opening 141*c* of the front side plate 141 and the photosensor 144, the state of the sheet discharge sensor holder 135 and the sheet discharge sensor 133 is changed from a roughly guided state by the guiding groove portions 135*fb* and 135*gb* to a guided state by the positioning groove portions 135*fa* and 135*ga*.

As shown in part (a) of FIG. 7, Y direction distances between the front side plate 141 and ends of the slide assisting portions 143*c* and 143*d*, on the side opposite from the front side plate 141, extending in the Y direction are E and F, respectively. On the other hand, a Y direction distance between the flag portion 133*c* and a boundary position between the slide assisting groove-positioning portion 135*fa* and the slide assisting groove-roughly guiding portion 135*fb* of the sheet discharge sensor holder 135 is G. A Y direction distance between the flag portion 133*c* and a boundary position between the slide assisting groove-positioning portion 135*ga* and the slide assisting groove-roughly guiding portion 135*gb* of the sheet discharge sensor holder 135 is H.

In this embodiment, the distances E and F ((a) of FIG. 7) are set so as to be substantially equal to or more than the distances G and H ((b) of FIG. 7), respectively. As a result, when the flag portion 133*c* passes through the opening 141*c* of the front side plate 141 and the photosensor 144, the state of the sheet discharge sensor holder 135 can be changed to the guided state by the slide assisting groove-positioning portions 135*fa* and 135*ga*.

(Assembling Method (Adjusting Method, Manufacturing Method) of Sheet Discharge Sensor Unit 13 by Sensor Flag Adjusting Unit)

An assembling method (adjusting method, manufacturing method) of the sheet discharge sensor unit 13 by the sensor flag adjusting unit in this embodiment will be described using FIGS. 9 and 11. With reference to FIGS. 9 to 11, the assembling method of the sheet discharge sensor unit 13 will be described step by step. In each of FIGS. 9 to 11, part (a) is a schematic view of the sheet discharge sensor unit 13 as seen in the Y direction (longitudinal direction of the fixing member), part 8*b*) is a schematic view of the sheet discharge sensor unit 13 as seen in the X direction (nip pressure direction), and part (c) is a schematic view of the sheet discharge sensor unit 13 as seen in the Z direction (recording material feeding direction).

A general outline of the assembling method (manufacturing method) is shown by arrows in part (a) of FIG. 3. That is, the sensor holder 135 holding the sensor flag 133 is displaced in the −Y direction (first direction) so that the flag portion 133*c* passes through the opening 141*c*. The sensor holder 135 is regulated, before movement, by the reinforcing stay 143 as the casing with respect to the X direction (second direction) perpendicular to the −Y direction and with respect to the −Z direction (third direction) perpendicular to the −Y direction. Then, the sensor holder 135 is capable of being displaced in the −Z direction after passing through the opening 141*c*. As a result, by a combination of translational motions, adjustment of the position of the flag portion 133*c* relative to the photosensor 144 is completed. This will be described specifically below.

First, as shown in part (c) of FIG. 8, the slide assisting portions 143*c* and 143*d* of the reinforcing stay 143 are engaged in the slide assisting groove-roughly guiding portions 135*fb* and 135*gb* of the sheet discharge sensor holder 135 (regulation of the position with respect to the X direction). At this time, the Z direction positions of the free ends of the height regulating bosses 135*d* and 135*e* as Z direction regulating portions of the sheet discharge sensor holder 135 are regulated by contact with the height regulating surface 143*e* of the reinforcing stay 143 ((b) of FIG. 8). The Z direction heights of the height regulating bosses 135*d* and 135*e* are lower than the Z direction heights of the slide assisting portions 143*c* and 143*d*. As a result, in a state in which the Z direction positions of the regulating bosses 135*d* and 135*e* are regulated by contact with the regulating surface 143*e*, the free ends of the slide assisting portions 143*c* and 143*d* can be engaged with the slide assisting groove roughly guiding portions 135*fb* and 135*gb*. The heights of the slide assisting portions 143*c* and 143*d* are lengths thereof with respect to the Z direction on the basis of the height regulating surface 143*d* of the reinforcing stay 143.

Here, the heights of the height regulating bosses 135*d* and 135*e* and the opening amount of the opening 141*c* of the front side plate 141 which are shown in (b) of FIG. 8 are set at h1 and W1, respectively, as described above ((c) of FIG. 6). For this reason, the flag portion 133*c* does not overlap with not only the sensor portion 144*a* of the photosensor 144 but also the front side plate 141 with respect to an X-Z projection direction (as seen in the Y direction). Further, at this time, the flag portion 133*c* exists on a side opposite from the photosensor 144 with respect to the front side plate 141 ((b) and (c) of FIG. 8).

Then, the sheet discharge sensor unit 13 is slid in the −Y direction so that the flag portion 133*c* moves toward the photosensor 144 (FIG. 9). The slide assisting portions 143*c* and 143*d* of the reinforcing stay 143 start to engage in the slide assisting groove positioning portion 135*fa* and the slide assisting groove guiding portion 135*ga* of the sheet discharge sensor holder 135. As a result, the sheet discharge sensor unit 13 is regulated with respect to the X direction, and is in a state in which rotation of the sheet discharge sensor unit 13 is also regulated with respect to X-Y direction. At this time, as described above with reference to parts (a) and (b) of FIG. 7, the relationships of E≥G and F≥H are satisfied, and therefore, the Z direction position of the sheet discharge sensor unit 13 does not fluctuate.

Then, until the flag portion 133*c* reaches the opening 141*c* of the front side plate 141, the sheet discharge sensor unit 13 is in a state of being guided by the slide assisting groove positioning portion 135*fa* and the slide assisting groove guiding portion 135*ga* ((c) of FIG. 9).

When the sheet discharge sensor holder 135 is further moved in the −Y direction from the state of FIG. 9, the flag portion 133*c* passes through the opening 141*c* of the front side plate 141 and then passes through above the photosensor 144 ((c) of FIG. 10). At this time, the Z direction position of the sheet discharge sensor unit 13 is kept regulated by the height regulating bosses 135*d* and 135*e* and the height regulating surface, and therefore, is moved in the −Y direction with no contact of the flag portion 133*c* with the front side plate 141 and the photosensor 144 (FIG. 10).

The Y direction distance C between the center of the height regulating boss 135*d* and the flag portion 133*c* and the Y direction distance D between the center of the positioning hole 143*a* of the reinforcing stay 143 and a Y direction center (intermediary position between the light emitting element and the sensor) of the optical axis of the photosensor 144, which distances C and D are shown in part (b) of FIG. 7, are substantially equal to each other. For this reason, when the flag portion 133*c* is moved to the Y direction center of the optical axis of the photosensor 144 (i.e., a center position between the sensor portion 144*a* and the light emitting portion 144*b*), the Z direction regulation of the sheet discharge sensor unit 13 by the height regulating surface 143*e* is eliminated. As a result, the sheet discharge sensor unit 13 can move in the −Z direction as shown from part (b) of FIG. 10 to part (c) of FIG. 11, so that the height regulating boss 135*d* enters the positioning hole 143*a* of the reinforcing stay 143. Then, the abutting surface 135*h* of the sheet discharge sensor holder 135 and the height regulating surface 143*e* of the reinforcing stay 143 contact each other and are set in an assembled state in which positional adjustment is completed (FIG. 11). The above-described assembling operation of the sheet discharge sensor unit 13 may be carried out by an operator or may also be carried out by an automatic machine. In the case where the assembling operation is carried out by the operator, the operator performs the assembling operation by moving the sheet discharge sensor holder 135 in the −Y direction and the −Z direction relative to the reinforcing stay 143 and the front side plate 141 as described above while holding the sheet discharge sensor holder 135. Further, in the case where the assembling operation is carried out by the automatic machine, the automatic machine, the arm of the automatic machine holds the sheet discharge sensor holder 135, and as described above, moves the sheet discharge sensor holder 135 in the −Y direction and the −Z direction relative to the reinforcing stay 143 and the front side plate 141.

Effect of this Embodiment

By employing the constitution of this embodiment, in the assembling operation of the movable member including the flag portion movable between the light emitting portion and the light receiving portion of the detecting portion, it is possible to provide the fixing device capable of positioning relative to the detecting portion with accuracy. Specifically, by using the constitution of this embodiment, as described above, the sheet discharge sensor unit 13 can be assembled without unintentional contact of the sheet discharge sensor unit 13 with peripheral component parts. Further, a movement locus of the sheet discharge sensor can be regulated to a minimum, and therefore, the opening amount W1 of the opening 141*c* of the front side plate 141 can be minimized, so that strength and rigidity of the front side plate 141 can be enhanced to a maximum. In addition, the sheet discharge sensor unit 13 can be assembled in a minimum necessary space only by a combination of translational motions, so that it is also possible to meet assembling by an inexpensive automatic machine without using the tilt assembling as in the prior art.

Modified Embodiments

In the above, a preferred embodiment of the present invention was described, but the present invention is not limited thereto, but can be modified and changed variously within a range of the scope of the present invention.

Modified Embodiment 1

In the above-described embodiment, two height regulating bosses 135*d* and 135*e* and two positioning holes 143*a* and 143*b* were used, but are used for stabilizing the attitude of the sheet discharge sensor holder 135, and therefore three or four height regulating bosses and three or more positioning holes may also be used. Further, a single height regulating boss and a single positioning hole may also be employed. In this case (where the single height regulating boss and the single positioning hole are employed), in order to stabilize the attitude of the sheet discharge sensor holder 135, a contact area of the free end portion of the height regulating boss 135*d* may preferably be increased.

Further, similarly, two slide assisting grooves 135*f* and 135*g* and two slide assisting portions 143*c* and 143*d* were also used, but three or more slide assisting grooves and three or more slide assisting portions may also be used. Further, a single slide assisting groove and a single slide assisting portion may also be employed. In this case (where the single slide assisting groove and the single slide assisting portion are employed), in order to stabilize the attitude of the sheet discharge sensor holder 135, an auxiliary length of each of the slide assisting portion 143*c* and the slide assisting groove 135*f* may preferably be increased.

Modified Embodiment 2

In the above-described embodiment, the constitution in which the sensor holder 135 is provided with the height regulating bosses 135*d* and 135*e* and the reinforcing stay 143 is provided with the positioning holes 143*a* and 143*b* was employed, but the shapes of the projected portions and recessed portions may also be an opposite relationship when the regulation with respect to the height direction and the rotational direction can be carried out. That is, a constitution in which one of the second regulating portion 135*d* and the positioning portion 143*a* is the projected portion and the other portion is the recessed portion may only be required to be employed. Specifically, a constitution in which the sensor holder 135 is provided with the positioning holes 143*a* and 143*b* and the reinforcing stay 143 is provided with the height regulating bosses 135*d* and 135*e* may also be employed.

Modified Embodiment 3

In the above-described embodiment, the cross-section of each of the height regulating bosses 135*d* and 135*e* in the X-Y plane is illustrated as a circular projected portion, and each of the positioning holes 143*a* and 143*b* is illustrated as a circular hole. However, the shapes of the height regulating bosses and the positioning holes may also be other shapes when a constitution in which the height regulating bosses 135*d* and 135*e* engage in the positioning holes 143*a* and 143*b* is employed.

Modified Embodiment 4

In the above-described embodiment, the height regulating bosses 135*d* and 135*e* and the slide assisting grooves 135*f* and 135*g* were provided separately in other shapes, but the height regulating function and the slide assisting function may also be achieved by a single stepwise shape portion.

Modified Embodiment 5

As regards the photosensor 144, in the −Y direction, the front side plate 141, the sensor portion 144*a* and the light emitting portion 144*b* were arranged in the named order. However, as regards the arrangement of the photosensor 144, with respect to the Y direction, a positional relationship between the sensor portion 144*a* and the light emitting portion 144*b* may also be reversed (inverted). That is, in the −Y direction, the front side plate 141, the light emitting portion 144*b* and the sensor portion 144*a* may also be arranged in the named order. In this case, in the movement of the sheet discharge sensor holder 135 in the −Y direction in the above-described operation, the height regulating bosses 135*d* and 135*e* regulates the Z direction position of the sheet discharge sensor holder 135 so that the flag portion 133*c* does not abut against the light emitting portion 144*b*.

Modified Embodiment 6

The opening 141*c* of the front side plate 141 has a hole shape (hole penetrating the front side plate 141 in the Y direction) such that an edge of the opening is connected thereto. However, the present invention is not limited thereto when a constitution in which in the movement of the sheet discharge sensor holder 135 in the −Y direction in the assembling operation, the flag portion 133*c* does not abut against the surface of the front side plate 141 is employed. For example, a U-shaped opening which opens in the X direction may also be used.

Modified Embodiment 7

In the above-described embodiment, the constitution in which the sheet discharge sensor unit 13 was assembled with the front side plate 141, the rear side plate 142 and the reinforcing stay 143 which rotatably support the pressing roller 120 was described. The present invention may also be applied to a constitution in which the sheet discharge sensor unit 13 is assembled with a front side plate, a rear side plate and a reinforcing stay which rotatably support the inner sheet discharging roller pair 70.

Modified Embodiment 8

The photosensor 144 was disposed on the front side plate 141 side, but may also be disposed on the rear side plate 142 side. Further, the relationship among the X direction, the Y direction and the Z direction is not limited to that in the above-described embodiment, but may also be a relationship such that the X, Y and Z directions are replaced with each other when a directional relationship in the assembling of the sheet discharge sensor holder 135 with the reinforcing stay 143 is the same relationship.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2017-022990 filed on Feb. 10, 2017 and 2017-236984 filed on Dec. 11, 2017, which are hereby incorporated by reference herein in their entirety.

What is claimed is:

1. A fixing device comprising:

first and second rotatable members forming a nip where a toner image on a recording material is fixed;

a movable member movable by arrival of the recording material at a predetermined position that is downstream of the nip with respect to a recording material feeding direction and that is within a passing region in which the recording material is passable, wherein said movable member includes a contact portion contactable to the recording material in the predetermined position and includes a flag portion movable together with movement of said contact portion by the recording material contacting said contact portion;

a first supporting side plate positioned outside the passing region and configured to rotatably support said first rotatable member, wherein said first supporting side plate includes an opening having such a size that said flag portion is passable therethrough;

a second supporting side plate positioned opposite from said first supporting side plate and configured to rotatably support said first rotatable member, said first supporting side plate and said second supporting side plate sandwiching the passing region therebetween with respect to the longitudinal direction;

a detecting portion including a light emitting portion and a light receiving portion, and configured to detect said flag portion movable between said light emitting portion and said light receiving portion, wherein said detecting portion is positioned on an outside of said first supporting side plate with respect to the longitudinal direction, the outside being opposite from the passing region, the outside and the passing region sandwiching said first supporting side plate therebetween with respect to the longitudinal direction;

a supporting plate extending in the longitudinal direction so as to be connected with said first and second supporting side plates;

a holding portion holding said movable member, wherein, in a state that said holding portion holds said movable member, said holding portion is assembled with said supporting plate connected with said first and second supporting side plates;

a slit portion configured to guide movement of said holding portion in a predetermined direction from the passing region toward the opening of said first supporting side plate so that said flag portion passes from the passing region through the opening in an assembling operation in which said holding portion is assembled with said supporting plate;

a first projected portion configured to guide the movement of said holding portion in the predetermined direction in engagement with said slit;

a second projected portion provided on said holding portion, wherein said second projected portion regulates a position of said holding portion relative to said supporting plate with respect to a height direction while in contact with said supporting plate when said holding portion is moved in the predetermined direction by being guided by said slit portion and said first projected portion, the height direction being perpendicular to a holding portion supporting surface of said supporting plate; and a hole provided in said supporting plate, wherein said hole is disposed at a position where said second projected portion engages with said hole when said flag portion is positioned between said light emitting portion and said light receiving portion with respect to the longitudinal direction by movement of said holding portion in the predetermined direction by guidance of said slit portion and said first projected portion, wherein, when the position of said holding portion with respect to the height direction is regulated by said second projected portion in contact with said supporting plate, in a projection plane in which the outside of said first supporting side plate is viewed in the longitudinal direction from a position between said light emitting portion and said receiving portion with respect to the longitudinal direction, said flag portion is accommodated inside said opening and is in a non-overlapping position with said detecting portion, and wherein, when said second projected portion is engaged in said hole, in the projection plane, said flag portion is in an overlapping position with said detecting portion.

2. A fixing device according to claim 1, wherein said second projected portion has a tapered shape such that a diameter of a free end portion of said second projected portion is smaller than a diameter of a base portion of said second projected portion.

3. A fixing device according to claim 1, wherein said holding portion includes a third projected portion regulating the position of said holding portion relative to said supporting plate with respect to the height direction while in contact with said supporting plate when said holding portion is moved in the predetermined direction by guidance of said slit portion and said first projected portion, and wherein said supporting plate is provided with a second hole disposed at a position where said third projected portion engages with said second hole when said flag portion is positioned between said light emitting portion and said light receiving portion with respect to the longitudinal direction by movement of said holding portion in the predetermined direction by guidance of said slit portion and said first projected portion.

4. A fixing device according to claim 1, wherein, when said holding portion is moved in the predetermined direction, said slit portion regulates a position of said first projected portion with respect to a direction perpendicular to the longitudinal direction and the height direction.

5. A fixing device according to claim 1, wherein said movable member is rotated by contact of said contact portion with the recording material in the predetermined position.

6. A fixing device according to claim 1, wherein said supporting plate is made of a metallic material, wherein said holding portion is made of a resin material, wherein said first projected portion has an elongated thin plate shape extending in the longitudinal direction and is provided on said supporting plate, and wherein said slit portion is provided in said holding portion.

7. A fixing device according to claim 1, further comprising a pair of rotatable feeding members positioned downstream of the nip with respect to the feeding direction so as to be adjacent to said first and second rotatable members and configured to form a feeding nip where the recording material fed from the nip is fed, and wherein, with respect to the feeding direction, said contact portion contacts the recording material in the predetermined position between the nip and the feeding nip.

8. A fixing device according to claim 1, wherein, when the position of said holding portion with respect to the height direction is regulated by said second projected portion in contact with said supporting plate, in the projection plane, said flag portion is accommodated inside said opening and is in a non-overlapping position with said light receiving portion of said detecting portion, and wherein, when said second projected portion is engaged in said hole, in the projection plane, said flag portion is in an overlapping position with said light receiving portion of said detecting portion.

9. A fixing device according to claim 1, wherein, when the position of said holding portion with respect to the height direction is regulated by said second projected portion in contact with said supporting plate, in the projection plane, said flag portion is accommodated inside said opening and is in a non-overlapping position with said light emitting portion of said detecting portion, and wherein, when said second projected portion is engaged in said hole, in the projection plane, said flag portion is in an overlapping position with said light emitting portion of said detecting portion.

10. A fixing device comprising:

first and second rotatable members forming a nip where a toner image on a recording material is fixed;

a movable member movable by arrival of the recording material at a predetermined position that is downstream of the nip with respect to a recording material feeding direction and that is within a passing region in which the recording material is passable, wherein said movable member includes a contact portion contactable to the recording material in the predetermined position and includes a flag portion movable together with movement of said contact portion by the recording material contacting said contact portion;

a first supporting side plate positioned outside the passing region and configured to rotatably support said first rotatable member, wherein said first supporting side plate includes an opening having such a size that said flag portion is passable therethrough;

a second supporting side plate positioned opposite from said first supporting side plate and configured to rotatably support said first rotatable member, said first supporting side plate and said second supporting side plate sandwiching the passing region therebetween with respect to the longitudinal direction;

a detecting portion including a light emitting portion and a light receiving portion, and configured to detect said flag portion movable between said light emitting portion and said light receiving portion, wherein said detecting portion is positioned on an outside of said first supporting side plate with respect to the longitudinal direction, the outside being opposite from the passing region, the outside and the passing region sandwiching said first supporting side plate therebetween with respect to the longitudinal direction;

a supporting plate extending in the longitudinal direction so as to be connected with said first and second supporting side plates;

a holding portion holding said movable member, wherein, in a state that said holding portion holds said movable member, said holding portion is assembled with said supporting plate connected with said first and second supporting side plates;

a slit portion configured to guide movement of said holding portion in a predetermined direction from the passing region toward the opening so that said flag portion passes from the passing region through the opening in an assembling operation in which said holding portion is assembled with said supporting plate;

a first projected portion configured to guide the movement of said holding portion in the predetermined direction in engagement with said slit;

a second projected portion provided on said supporting plate, wherein said second projected portion regulates a position of said holding portion relative to said supporting plate with respect to a height direction while in contact with said holding portion when said holding portion is moved in the predetermined direction by being guided by said slit portion and said first projected portion, the height direction being perpendicular to a holding portion supporting surface of said supporting plate; and a hole provided in said holding portion, wherein said hole is disposed at a position where said second projected portion engages with said hole when said flag portion is positioned between said light emitting portion and said light receiving portion with respect to the longitudinal direction by movement of said holding portion in the predetermined direction by guidance of said slit portion and said first projected portion, wherein, when the position of said holding portion with respect to the height direction is regulated by said second projected portion in contact with said holding portion, in a projection plane in which the outside of said first supporting side plate is viewed in the longitudinal direction from a position between said light emitting portion and said receiving portion with respect to the longitudinal direction, said flag portion is accommodated inside said opening and is in a non-overlapping position with said detecting portion, and wherein, when said second projected portion is engaged in said hole, in the projection plane, said flag portion is in an overlapping position with said detecting portion.

11. A fixing device according to claim 10, wherein said second projected portion has a tapered shape such that a diameter of a free end portion of said second projected portion is smaller than a diameter of a base portion of said second projected portion.

12. A fixing device according to claim 10, wherein said supporting plate includes a third projected portion regulating the position of said holding portion relative to said supporting plate with respect to the height direction while in contact with said holding portion when said holding portion is moved in the predetermined direction by guidance of said slit portion and said first projected portion, and wherein said holding portion is provided with a second hole disposed at a position where said third projected portion engages with said second hole when said flag portion is positioned between said light emitting portion and said light receiving portion with respect to the longitudinal direction by movement of said holding portion in the predetermined direction by guidance of said slit portion and said first projected portion.

13. A fixing device according to claim 10, wherein, when said holding portion is moved in the predetermined direction, said slit portion regulates a position of said first projected portion with respect to a direction perpendicular to the longitudinal direction and the height direction.

14. A fixing device according to claim 10, wherein said movable member is rotated by contact of said contact portion with the recording material in the predetermined position.

15. A fixing device according to claim 10, wherein said supporting plate is made of a metallic material, wherein said holding portion is made of a resin material, wherein said first projected portion has an elongated thin plate shape extending in the longitudinal direction and is provided on said supporting plate, and wherein said slit portion is provided in said holding portion.

16. A fixing device according to claim 10, further comprising a pair of rotatable feeding members positioned downstream of the nip with respect to the feeding direction so as to be adjacent to said first and second rotatable members and configured to form a feeding nip where the recording material fed from the nip is fed, and wherein, with respect to the feeding direction, said contact portion contacts the recording material in the predetermined position between the nip and the feeding nip.

17. A fixing device according to claim 10, wherein, when the position of said holding portion with respect to the height direction is regulated by said second projected portion in contact with said holding portion, in the projection plane, said flag portion is accommodated inside said opening and is in a non-overlapping position with said light receiving portion of said detecting portion, and wherein, when said second projected portion is engaged in said hole, in the projection plane, said flag portion is in an overlapping position with said light receiving portion of said detecting portion.

18. A fixing device according to claim 10, wherein, when the position of said holding portion with respect to the height direction is regulated by said second projected portion in contact with said holding portion, in the projection plane, said flag portion is accommodated inside said opening and is in a non-overlapping position with said light emitting portion of said detecting portion, and wherein, when said second projected portion is engaged in said hole, in the projection plane, said flag portion is in an overlapping position with said light emitting portion of said detecting portion.

19. An image forming apparatus comprising:

an image forming portion configured to form a toner image on a recording material;

first and second rotatable members configured to feed the recording material through a nip therebetween;

a movable member movable by arrival of the recording material at a predetermined position that is downstream of the nip with respect to a recording material feeding direction and that is within a passing region in which the recording material is passable, wherein said movable member includes a contact portion contactable to the recording material in the predetermined position and includes a flag portion movable together with movement of said contact portion by the recording material contacting said contact portion;

a first supporting side plate positioned outside the passing region with respect to the longitudinal direction and configured to rotatably support said first rotatable member, wherein said first supporting side plate includes an opening having such a size that said flag portion is passable therethrough;

a second supporting side plate positioned opposite from said first supporting side plate and configured to rotatably support said first rotatable member, said first supporting side plate and said second supporting side plate sandwiching the passing region therebetween with respect to the longitudinal direction;

a detecting portion including a light emitting portion and a light receiving portion, and configured to detect said flag portion movable between said light emitting portion and said light receiving portion, wherein said detecting portion is positioned on an outside of said first supporting side plate with respect to the longitudinal direction, the outside being opposite from the passing region, the outside and the passing region sandwiching the first supporting side plate therebetween with respect to the longitudinal direction;

a supporting plate extending in the longitudinal direction so as to be connected with said first and second supporting side plates;

a holding portion holding said movable member, wherein, in a state that said holding portion holds said movable member, said holding portion is assembled with said supporting plate connected with said first and second supporting side plates;

a slit portion configured to guide movement of said holding portion in a predetermined direction from the passing region toward the opening of said first supporting side plate so that said flag portion passes from the passing region through the opening in an assembling operation in which said holding portion is assembled with said supporting plate;

a first projected portion configured to guide the movement of said holding portion in the predetermined direction in engagement with said slit;

a second projected portion provided on said holding portion, wherein said second projected portion regulates a position of said holding portion relative to said supporting plate with respect to a height direction while in contact with said supporting plate when said holding portion is moved in the predetermined direction by being guided by said slit portion and said first projected portion, the height direction being perpendicular to a holding portion supporting surface of said supporting plate; and a hole provided in said supporting plate, wherein said hole is disposed at a position where said second projected portion engages with said hole when said flag portion is positioned between said light emitting portion and said light receiving portion with respect to the longitudinal direction by movement of said holding portion in the predetermined direction by guidance of said slit portion and said first projected portion, wherein, when the position of said holding portion with respect to the height direction is regulated by said second projected portion in contact with said supporting plate, in a projection plane in which the outside of said first supporting side plate is viewed in the longitudinal direction from a position between said light emitting portion and said receiving portion with respect to the longitudinal direction, said flag portion is accommodated inside said opening and is in a non-overlapping position with said detecting portion, and wherein, when said second projected portion is engaged in said hole, in the projection plane, said flag portion is in an overlapping position with said detecting portion.

20. An image forming apparatus comprising:

an image forming portion configured to form a toner image on a recording material;

first and second rotatable members configured through a nip therebetween;

a movable member movable by arrival of the recording material at a predetermined position that is downstream of the nip with respect to a recording material feeding direction and that is within a passing region in which the recording material is passable, wherein said movable member includes a contact portion contactable to the recording material in the predetermined position and includes a flag portion movable together with movement of said contact portion by the recording material contacting said contact portion;

a first supporting side plate positioned outside the passing region and configured to rotatably support said first rotatable member, wherein said first supporting side plate includes an opening having such a size that said flag portion is passable therethrough;

a second supporting side plate positioned opposite from said first supporting side plate and configured to rotatably support said first rotatable member, said first supporting side plate and said second supporting side plate sandwiching the passing region therebetween with respect to the longitudinal direction;

a detecting portion including a light emitting portion and a light receiving portion, and configured to detect said flag portion movable between said light emitting portion and said light receiving portion, wherein said detecting portion is positioned on an outside of said first supporting side plate with respect to the longitudinal direction, the outside being opposite from the passing region, the outside and the passing region sandwiching the first supporting side plate therebetween with respect to the longitudinal direction;

a supporting plate extending in the longitudinal direction so as to be connected with said first and second supporting side plates;

a holding portion holding said movable member, wherein, in a state that said holding portion holds said movable member, said holding portion is assembled with said supporting plate connected with said first and second supporting side plates;

a slit portion configured to guide movement of said holding portion in a predetermined direction from the passing region toward the opening so that said flag portion passes from the passing region through the opening in an assembling operation in which said holding portion is assembled with said supporting plate;

a first projected portion configured to guide the movement of said holding portion in the predetermined direction in engagement with said slit;

a second projected portion provided on said supporting plate, wherein said second projected portion regulates a position of said holding portion relative to said supporting plate with respect to a height direction while in contact with said holding portion when said holding portion is moved in the predetermined direction by being guided by said slit portion and said first projected portion, the height direction being perpendicular to a holding portion supporting surface of holding portion; and a hole provided in said holding portion, wherein said hole is disposed at a position where said second projected portion engages with said hole when said flag portion is positioned between said light emitting portion and said light receiving portion with respect to the longitudinal direction by movement of said holding portion in the predetermined direction by guidance of said slit portion and said first projected portion, wherein, when the position of said holding portion with respect to the height direction is regulated by said second projected portion in contact with said holding portion, in a projection plane in which the outside of said first supporting side plate is viewed in the longitudinal direction from a position between said light emitting portion and said receiving portion with respect to the longitudinal direction, said flag portion is accommodated inside said opening and is in a non-overlapping position with said detecting portion, and wherein, when said second projected portion is engaged in said hole, in the projection plane, said flag portion is in an overlapping position with said detecting portion.

* * * * *